US006925780B1

(12) United States Patent
Anderson

(10) Patent No.: US 6,925,780 B1
(45) Date of Patent: Aug. 9, 2005

(54) PLUG AND GLAND ASEPTIC PACKAGE SYSTEM

(75) Inventor: Ian McArthur Anderson, Warnett (AU)

(73) Assignee: Visy Films & Laminates Pty Limited, Melbourne (AU)

( * ) Notice: Subject to any disclaimer, the term of this patent is extended or adjusted under 35 U.S.C. 154(b) by 0 days.

(21) Appl. No.: 09/720,604

(22) PCT Filed: Jun. 25, 1999

(86) PCT No.: PCT/AU99/00514

§ 371 (c)(1),
(2), (4) Date: Apr. 9, 2001

(87) PCT Pub. No.: WO00/00390

PCT Pub. Date: Jan. 6, 2000

(30) Foreign Application Priority Data

Jun. 29, 1998 (AU) ..... PP4374
Jan. 20, 1999 (AU) ..... PP8262

(51) Int. Cl.[7] ..... B67B 1/03
(52) U.S. Cl. ..... 53/426; 53/471; 53/109; 53/275
(58) Field of Search ..... 53/426, 317, 319, 53/329.2, 404, 407, 471, 485, 489, 80, 88, 53/101, 109, 275, 284.5, 290, 264; 215/355

(56) References Cited

U.S. PATENT DOCUMENTS 2,339,035 A * 1/1944 Stewart et al. ..... 53/407
3,140,007 A * 7/1964 Nettleship ..... 206/508
3,516,224 A * 6/1970 Caccini ..... 53/510
3,900,122 A 8/1975 Dichter
4,148,933 A * 4/1979 Janovtchik ..... 426/402
4,186,542 A * 2/1980 Oyagi ..... 53/88

(Continued)

FOREIGN PATENT DOCUMENTS

| | | |
|---|---|---|
| AU | 21354/88 | 3/1989 |
| WO | WO 89/00952 | 2/1999 |

OTHER PUBLICATIONS

JP 10045156 A (Toppan Printing Co Ltd) Feb. 17, 1998 and Derwent Abstract Accession No. 98-188789/17, Class Q33 !34, Feb. 17 1998.

*Primary Examiner*—John Paradiso
(74) *Attorney, Agent, or Firm*—Kenyon & Kenyon

(57) ABSTRACT

A method of aseptically filling an internally sterilized sealed container having a transfer port which comprises a tubular body which is sealed to the wall of the container and defines a flow passage therethrough, and a sealing plug engaged into the passage, the tubular body having an annular outer sealing face thereon which surrounds the flow passage, including the steps of: supporting the tubular body of the container in a selected orientation and position; providing a sterilization and filling head having at least an outer sealing ring thereon which is adapted to engage and seal with the annular sealing face, and a sterilization chamber located inwards of and at least partially defined by the outer sealing ring; bringing the sterilization and filling head and the tubular body into engagement with each other so that the outer sealing face; introducing a sterilization fluid into the sterilization chamber to sterilize at least the radially outer part of the plug and that part of the tubular body within the outer sealing ring; withdrawing the plug out of the tubular body in a direction away from the container whilst maintaining the sealing ring in sealed contact with the sealing face; introducing a flowable material into the container through the tubular body; reinserting the plug into the tubular body to thereby close the tubular body; and disengaging the sterilization and filling head and the tubular body from each other.

51 Claims, 20 Drawing Sheets

U.S. PATENT DOCUMENTS 4,838,008 A * 6/1989 Hardy ..... 53/407
4,848,419 A * 7/1989 Damen ..... 141/61
4,972,652 A * 11/1990 Critchley et al. ..... 53/468
5,054,260 A * 10/1991 Herzog ..... 53/307
5,054,265 A * 10/1991 Perigo et al. ..... 53/425
5,064,085 A * 11/1991 Ellenberg ..... 215/355
5,303,837 A * 4/1994 Adams et al. ..... 220/258.3
5,479,955 A 1/1996 Roodvoets et al.
5,860,461 A * 1/1999 Helmut ..... 141/326
6,341,472 B1 * 1/2002 Schroeder ..... 53/426

* cited by examiner

PLUG AND GLAND ASEPTIC PACKAGE SYSTEM

FIELD OF THE INVENTION

This invention relates to a method of aseptically filling containers, apparatus for the aseptic filling of containers, to containers incorporating an inlet assembly with which the method may be used, and to a plug and gland port for such containers.

BACKGROUND OF THE INVENTION

The filling of pre-sterilized containers in an aseptic manner is known and various systems are employed which utilize different filling apparatus, different containers, and different sterilization techniques. Specifically, the container to be filled is produced in a manner which ensures that the interior of the container is sterilized during manufacture. During the filling procedure an inlet into the container is opened and a filling nozzle used to fill the container with a selected flowable material. The inlet is then sealed to thereby contain the flowable material within the container until dispensing is required. To ensure that the contents of the container is kept as free of contaminating bacteria and other micro organisms as possible it is essential that the act of filling the container does not in itself introduce contaminants into the interior of the container. Also, the resealing of the container after it is filled must be done in such a way that a proper seal is achieved so that contamination does not take place during transportation or storage.

Various prior art patents have addressed the aforementioned problems and reference may be made to U.S. Pat. No. 4,805,378 (Anderson), U.S. Pat. No. 2,930,170 (Holsman et al), U.S. Pat. No. 4,542,530 (Thomas et al) and U.S. Pat. No. 4,672,688 (Kalkipsakis). These prior art patents describe systems which are successful to a greater or lesser extent. However, the prior art systems do suffer from certain deficiencies, at least under some filling circumstances.

For example, U.S. Pat. No. 4,805,378 discloses an arrangement in which a flap is positioned across the mouth of the filling inlet, which provides some measure of obstruction to the flowable material entering the container. Current food processing plants can produce product at a rate of in excess of 20,000 liters per hour and it is important that the container is able to receive a product at this flow rate in order to avoid providing multiple head filling systems and the like. To achieve filling rates of this order relatively large diameter filling inlets are required into the containers and the flap system disclosed in U.S. Pat. No. 4,805,378, limits the diameter and flow rate into the container. Also, for highly viscous materials, and for materials which contain solid particles, the flap system is not always completely suitable.

The U.S. Pat. No. 4,805,378 discloses a container which is filled via an upstanding plastics collar, at one end of which a first flange is heat fused to the flexible plastic sheet wall of the container surrounding a filling opening in the container and, at a second flange at the opposite end of the collar, a rupturable sheet plastics membrane is also heat fused. The sheet plastics membrane, which is heat sterilized in manufacture but which most likely would be recontaminated externally before filling, is resterilized immediately prior to filling by a fluid (for example pressurized steam) after being brought into engagement with a filling head of an aseptic filler. In the described method, an incision tool forming part of the filling head, sterilized along with the exterior of the membrane, is advanced to cut the membrane then withdrawn to enable admission of the liquid to be packaged through the collar and through gaps formed between the flap partially heat fused to the flange inside the container.

As discussed in U.S. Pat. No. 4,805,378, the cutting of the resterilized membrane involves making a pair of straight incisions, crossed at right angles passing through the center of the membrane and extending radially outward to a point just inside the outer flange of the upstanding plastics collar. Accordingly, as the liquid or liquid-like product flows into the bag to fill it, the four cut tips or "reversed petals" of the membrane turn inwardly with the flow and extend towards the inner and end of the collar where it is connected to the bag in the region that is subsequently sealed closed as described. There are occasionally experienced instances of unreliability with this arrangement in that the four petals of the top membrane, since they remain on the filled sealed package, are difficult to clean underneath to remove remnants of the packaged product inside of the collar during the flushing cycle. Also, the petals tend to reduce the flow rate of the product into the container during filling which can be disadvantageous from a production point of view with viscous or particulate containing products.

There is furthermore a risk that the tips of the petals might wrap underneath the inside corner of the flange and be caught up in the subsequent final heat sealing operation. If this were to happen there would be a potential for a leakage path to bypass the seal or, at least, a potential source of failure of the seal. Accordingly, the axial height of the collar should be sufficient in relation to the diameter opening to prevent this possibility. In use commercially, the diameter of opening as disclosed in the Anderson patent is known to be in the range of 16–32 mm. With the desired future extension of the size of opening up to 60 mm or 70 mm, using the arrangement disclosed in the patent would require a corresponding increase in axial height of the collar. There would be no other need to increase the height of the collar other than to ensure that the cut petals of the membrane could not enter the sealing region, but such a high profile of collar would be unacceptable in general to fillers and end users of the package alike. It is therefore an object of this invention to provide a method which will overcome the disadvantages associated with a rupturable outer membrane.

Typically, the aforementioned packaging systems are used with high acid products, predominantly tomato paste, orange juice and juice concentrates. It is also known to use this type of packaging system with low acid products, such as milk, cream and egg pulp for example.

Manufacturers are beginning to take advantage of processing system developments and market acceptance, for an increased range of particulate and concentrate products. The types of products currently being considered for packaging are pineapple chunks, diced tomatoes, ready prepared meals, meat sauces, fruit particulate, and various other similar type products. These products come in a range of different acidities and larger diameter filling nozzles are generally required in order to fill containers at the required flow rate and accommodate larger particulate sizes.

Containers having capacity of 1,000 liters or more are typically used for bulk packaging and with increased capacity of processing plants there is currently a need for a high capacity, highly aseptic packaging system that utilizes a large diameter filling nozzle and provides a high quality seal after filling and which can be used with low acid products.

SUMMARY OF THE INVENTION

According to the invention there is provided a method of aseptically filling an internally sterilized container having a transfer port which comprises a tubular body which is sealed to the wall of the container and defines a flow passage therethrough, and a sealing plug engaged into the passage, the tubular body having an annular outer sealing face thereon which surrounds the flow passage, the method comprising the steps of:

supporting the tubular body of the container in a selected orientation and position;

providing a sterilization and filling head having at least an outer sealing ring thereon which is adapted to engage and seal with the annular sealing face, and a sterilization chamber located within the outer sealing ring;

bringing the sterilization and filling head and the tubular body into engagement with each other so that the outer sealing ring engages and seals with the annular sealing face;

introducing a sterilization fluid into the sterilization chamber to sterilize at least the radially outer part of the plug and that part of the tubular body within the sealing ring;

withdrawing the plug out of the tubular body in a direction away from the container whilst maintaining the sealing ring in sealed contact with the sealing face;

introducing a flowable material into the container through the tubular body;

reinserting the plug into the tubular body to thereby close the tubular body; and disengaging the sterilization and filling head and the tubular body from each other.

The method may include the further steps of:

providing the sterilization and filling head with an inner sealing ring which is co-axial with the outer sealing ring, the sterilization chamber being formed in the annular space between the two sealing rings;

providing a plug with an annular sealing face thereon which is co-axial with the annular sealing face on the tubular body and is adapted to be engaged by the inner sealing ring;

bringing the sterilization and filling head and the tubular body into engagement with each other so that the outer sealing ring engages and seals with the annular sealing face on the body, and the inner sealing ring engages and seals with the annular sealing face on the plug; and introducing the sterilization fluid into the annular sterilization chamber.

The method may further include the steps of:

providing a gripping jaw on the sterilization and filling head within the outer sealing ring; and gripping the plug with the gripping jaw in order to withdraw the plug from the tubular body.

The method may include the further steps of:

maintaining the outer sealing ring in sealing engagement with the annular sealing face on the body, and the inner sealing ring in sealing engagement with the sealing face on the plug;

gripping the plug with the gripping jaw; and extracting the plug from the tubular body whilst maintaining the inner sealing ring in sealing engagement with the sealing face on the plug.

The method may include the further steps of:

partially inserting the plug into the tubular body;

cleaning the peripheral outer surfaces of the plug prior to fully inserting the plug into the tubular body; and fully inserting the plug into the tubular body.

The step of cleaning the peripheral outer surfaces of the plug may be achieved by introducing a sterilization fluid into the sterilization chamber with the plug partially inserted into the flow passage in the tubular body.

The method may include the steps of sealing the plug to the tubular body during or after the plug has been reinserted into the tubular body. The sealing may be achieved by welding the plug in to the tubular body. The welding may be done using high temperature sterilization fluid, preferably steam.

According to a second aspect of the invention there is provided a sterilization and filling apparatus for aseptic filling of sterile containers having a filling nozzle comprising a tubular body with a flow passage therethrough and a plug for closing the flow passage, at least the tubular body having an annular sealing face thereon, the apparatus comprising:

holding means for holding the container and/or the tubular body in a selected position;

a sterilization and filling head having at least an outer annular sealing ring adapted to engage the annular sealing face on the tubular body, the sterilization and filling head having a sterilization chamber located inwards of the outer sealing ring, the sterilization and filling head having a cavity therein adapted to receive the plug of a container to be filled, the sterilization and filling head and/or the tubular body being movable towards and away from the other;

sterilization fluid supply means adapted to supply sterilization fluid to the sterilization chamber;

a plug extractor adapted to extract a plug from the tubular body and move the plug into the cavity in the sterilization and filling head; and filling means adapted to fill the container through the sterilization and filling head when the plug has been extracted.

Preferably the sterilization and filling head includes an inner sealing ring which is co-axial with said outer sealing ring and spaced inwardly therefrom to define an annular space therebetween, said annular space forming said sterilization chamber, said inner sealing ring being engageable with a sealing face provided on the plug.

The plug extractor may comprise one or more gripping jaws adapted to grip the plug and extract it from the tubular body into the cavity. The jaws may be mounted to a ram, which is moveable in an axial direction towards and away from the plug, the jaws being moveable between gripping and release positions.

Preferably the jaws automatically move to a gripping position when the ram moves in direction away from the plug, and move into the release position when the ram moves towards the plug. The ram may be adapted to drive the plug into the tubular passage after the container has been filled.

The sterilization and filling head may be adapted to shut off the flow of filling material into the container prior to the plug being fully inserted into the tubular passage. The sterilization and filling head may, furthermore, be adapted to clean the plug with sterilization fluid when the plug is partially re-inserted back into the tubular passage.

A further aspect of the invention provides an aseptic container adapted to be filled with a flowable material, the aseptic container having a filling opening comprising a tubular body having a flow passage therethrough, and a plug for sealing the flow passage, the plug having gripping formations on the outer face thereof, and retaining means or formations thereon for cooperatively or cooperatively locking the plug into the flow passage.

Preferably said gripping formations will allow the application of an axially directed force to be applied to the plug to remove or re-install the plug into the filling opening. Alternatively the gripping formations will allow the applications of a rotational force to be applied to the plug to remove or re-install the plug into the filling opening.

Preferably the plug is removed and reinstalled into said opening by axial means, preferably of a slide or interference fit. Alternatively the plug and opening may include a screw thread or cam or bayonet locking means.

Optionally the plug may be cup shaped having an end wall and a cylindrical skirt depending from the end wall, the end wall adapted to be outermost when the plug is inserted into the flow passage. The gripping formations may be formed on the end wall and project in a direction which is opposite to that in which the skirt extends from the end wall. The gripping formations may take the form of a head which stands proud of the end wall. The head may be undercut to provide purchase for the gripping jaw which is adapted to extract the plug from the flow passage. The locking formations may comprise a radially outwardly projecting annular rib formed on the plug, said rib being adapted to locate behind a shoulder, end face or within a groove formed in or adjacent the flow passage. The flow passage and/or the plug may have an annular seal therein adapted to seal with a plug inserted into the annular passage.

The plug and/or the tubular body may both be formed of a thermoplastic material adapted to bond together under temperatures of between about 130° C. and 180° C.

The plug and the tubular body may be sealed together during manufacture. That seal may be mechanically rupturable, or it may be adapted to be weakened under temperatures of between about 130° C. and 180° C. thereby providing an arrangement for simplified extraction of the plug after it has been sterilized by a high temperature sterilization fluid.

According to a further aspect of the invention there is provided a plug and gland port for use on an aseptic container, said port comprising:

a tubular body having a flow passage therethrough defined by a cylindrical inner wall of the tubular body, and a plug for sealing the flow passage, the plug having gripping formations on the outer face thereof, and retaining means or formations thereon for locking the plug into the flow passage, said retaining means comprising an annular recess formed around the periphery of the plug, and an annular rib or lip formed around and standing proud of the cylindrical inner wall of the tubular body, the rib or lip being adapted to locate in the recess to form a locating and/or sealing engagement with the recess when the plug is operatively installed within the tubular body.

Preferably the annular recess on the plug is at least partially filled with a sealing ring. The sealing ring may be in the form of a low melt sealant deposited in said recess. The low melt sealant may comprise a material such as a polyolefin elastomer.

Preferably the rib or lip on the cylindrical inner wall is spaced a first distance away from the operatively outer end face of the tubular body. Preferably the annular recess on the recess on the plug is spaced a second distance away from the operatively outer end face of the plug, said second distance being less than said first distance.

The plug may have a second annular recess formed around the periphery thereof, said annular recess being spaced from the first annular recess, the second annular recess being spaced a distance away from the operatively end face of the plug by a distance which is substantially the same as the distance which is substantially the same as the distance which the rib or lip is spaced away from the operatively outer end face of the gland so that when the rib or lip is located within the second annular recess the operatively outer end faces of the gland and the plug are substantially flush with each other. Prior to filling the container the gland and plug may be welded together.

The rib or lip may have a generally triangular form in cross section so as to provide a chamfered or severed face in both an outwardly facing direction and an inwardly facing direction to allow for simplified engagement and disengagement of the plug with the gland.

These and further features of the invention will be made apparent from the description of preferred embodiments thereof given below by way of examples. In the description reference is made to the accompanying drawings, but the specific feature shown in the drawings should not be construed as limiting on the invention.

In this specification and claims, where the words "comprising", "comprised" or words derived therefrom are used, those terms are to be interpreted inclusively rather than exclusively.

DETAILED DESCRIPTION OF THE EMBODIMENTS

Figure 1:
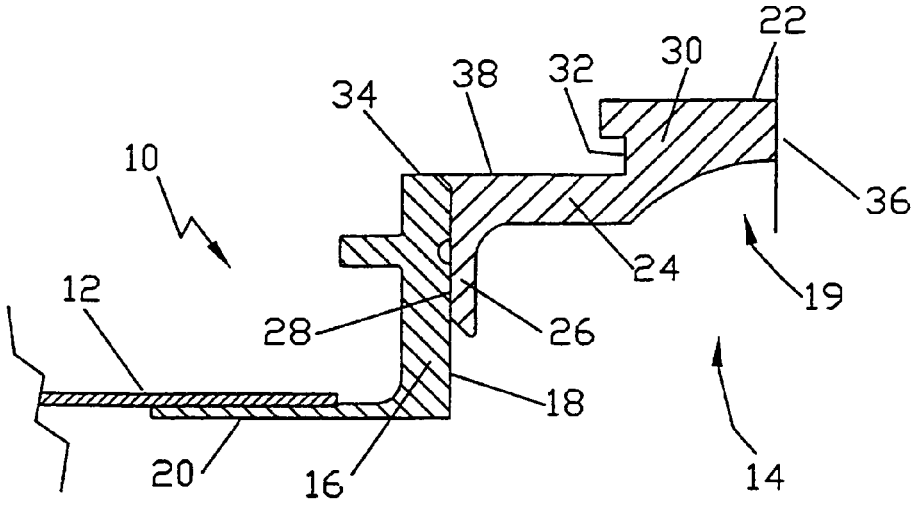
FIG. 1 shows a cross sectional half view through part of a container and the transfer port into the container according to the first embodiment of the invention, the other half view being a mirror image of FIG. 1.

Turning initially to FIG. 1, a container 10 is shown having a flexible wall 12 with a transfer port 14 therethrough which is used to introduce a flowable material into the container and through which the material may be, but is not necessarily, dispensed from the container. The transfer port 14 includes a tubular body 16 (also referred to in the art as a nozzle or gland) having a cylindrical inner wall 18 which defines a flow passage 19 through the body. An outwardly directed flange 20 serves as a bonding surface to which the container wall 12 is affixed thereby providing a fluid tight seal between the container wall and the body 16. A plug is provided for closing the passage 19 through the tubular body 16, the plug 22 having an end wall 24 and a skirt 26 which is attached to the periphery of the wall 24 and has an outer surface 28 which is a tight friction fit with the inner wall 18 of the body. The wall 24 has an upstanding head 30 which is undercut as indicated at numeral 32 to define a gripping region for the extraction of the plug out of the body 16. The outer face 34 of the tubular body is generally perpendicular to the axis 36 of the tubular body and defines a sealing face with which a sterilization and filling head 39 will engage, as described in more detail herebelow. The outer face 38 of the plug is similarly perpendicular to the axis 36 and also defines a sealing face with which the sterilization and filling head will engage.

Figure 2:
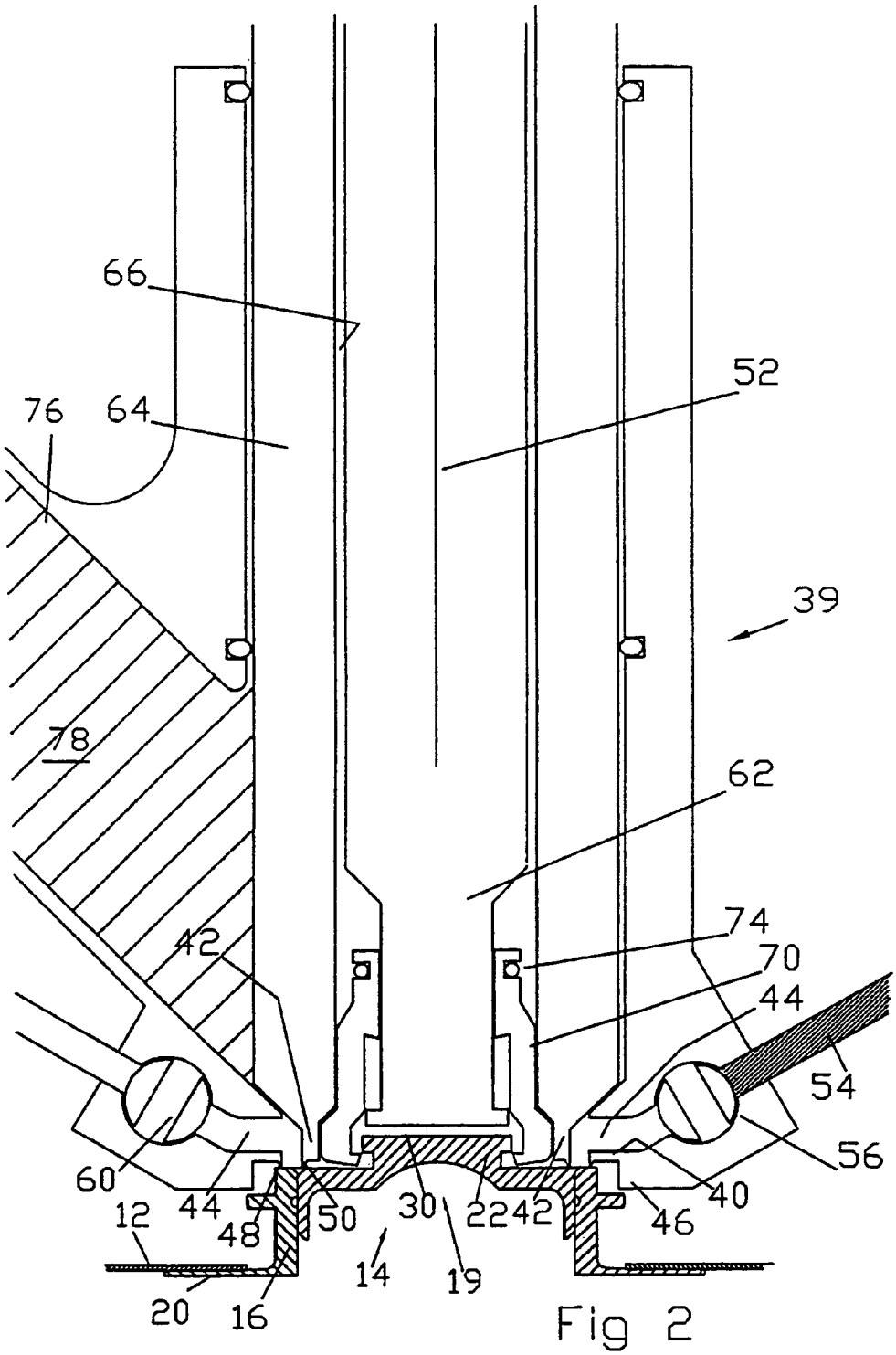
FIG. 2 shows the cross sectional side view of a sterilization head according to the invention in engagement with the port shown in FIG. 1.
Figure 3:
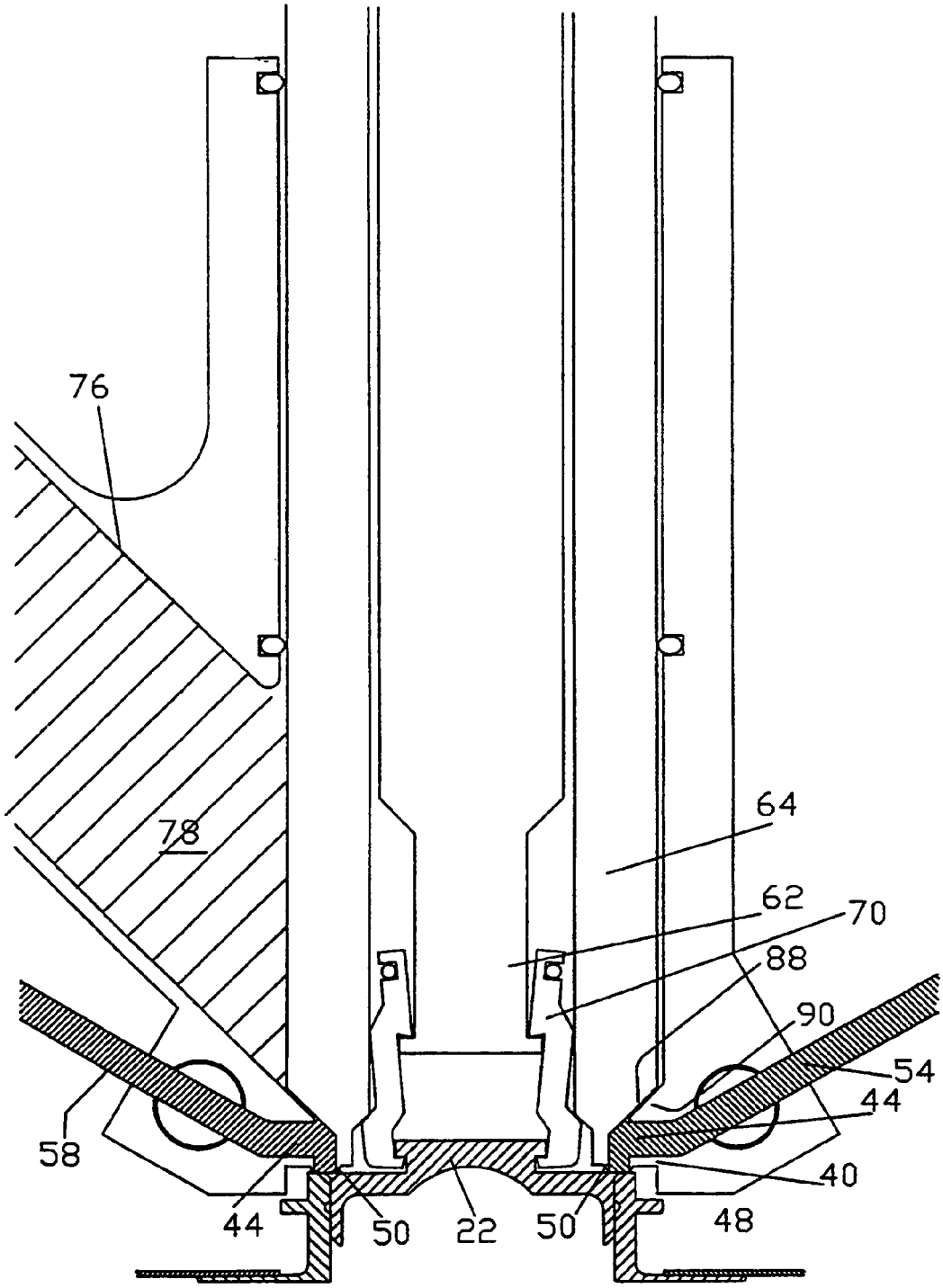
FIG. 3 shows a similar view to the of FIG. 2 with sterilization fluid sterilizing the outer surface of the transfer port.

Turning to FIG. 2 of the drawings, a sterilization and filling head 39 is shown comprising an outer sealing ring 40, an inner sealing ring 42 between which is formed a sterilization chamber 44. The outer sealing ring 40 has a downwardly extending flange 46 which locates around the outer periphery of the tubular body 16, and the sealing ring 40 includes a sharp edged blade 48 which is adapted to engage with and bite into the sealing face 34 on the body 16. The inner sealing ring 42 similarly has an annular blade 50, which is adapted to bite into and seal with the sealing face 38 on the plug 22.

In order to commence the filling operation the sterilization and filling head 39 and the upper surface of the transfer port 14 are brought into engagement with each other, as shown in FIG. 2. This is most conveniently done by gripping the transfer port with gripping jaws (not shown) and lifting the transfer port in the direction of axis 52 until the sealing faces 34 and 38 engage and seal with the sealing rings 40 and 42 respectively.

The sterilization and filling head is provided with a sterilization fluid supply line 54 which leads into the sterilization chamber 44 and which is controlled by an inlet valve 56. A sterilization fluid discharge line 58 leads from the sterilization chamber 44 and is controlled by an exit valve 60. The sterilization fluid will generally comprise steam supplied under pressure at a temperature of between 130° C. and 180° C.

The inner sealing ring 42 is formed on the end of a sliding sleeve 64, which is slideable along axis 52 towards and away from the transfer port 14. The sliding sleeve 64 serves as a control valve for controlling the flow of a flowable product into the container, as is described in more detail below.

An axially moveable plunger or ram 62 is moveable along axis 52 within a cylindrical cavity 66 formed within the sleeve 64. The ram 62 has a series of gripping jaws 70 fitted to the end thereof which are spring loaded by means of a spring 74. The gripping jaws 70 are adapted to engage with the head 30 of the plug 22 in order to pull the plug 22 out of the tubular passage 19.

The sterilization and filling head 39 is provided with a product supply passage 76 through which product to be filled into the container 10 is fed through the head. When the sleeve is retracted to the position shown in FIG. 4 product will flow into the container through the passage 76.

In use, the apparatus operates substantially as follows. Firstly, the tubular body 16 is brought into engagement with the outer sealing ring 40 so that the blade edge 48 embeds into the sealing face 34. The tubular body 16 will be held under pressure against this blade edge 48 for the entire filling process so that a seal will be maintained. Simultaneously the inner blade edge 50 will bed into the sealing face 38 of the plug 22. At this stage the sterilization cavity 44 will be a sealed cavity. It will be noted that the outer sealing ring 40 and the inner sealing ring 42 are located on opposite side of the interface between the tubular body 16 and the plug 22.

In this position, the sterilization head will be tightly clamped against the transfer port 14, and the ram 52 will be lifted causing the jaws 70 to clamp tightly around the head 30, thereby gripping the head 30. Thereafter, the sterilization chamber 44 will be flushed with a high temperature sterilization fluid, typically steam under pressure, to thereby clean all exposed surfaces within the sterilization chamber of any contaminating micro organisms. It should be noted that since the gap between the inner and outer sterilization rings is small, only a small area of the transfer port needs to be sterilized which allows for relatively high temperature sterilization, and short exposure time.

Figure 4:
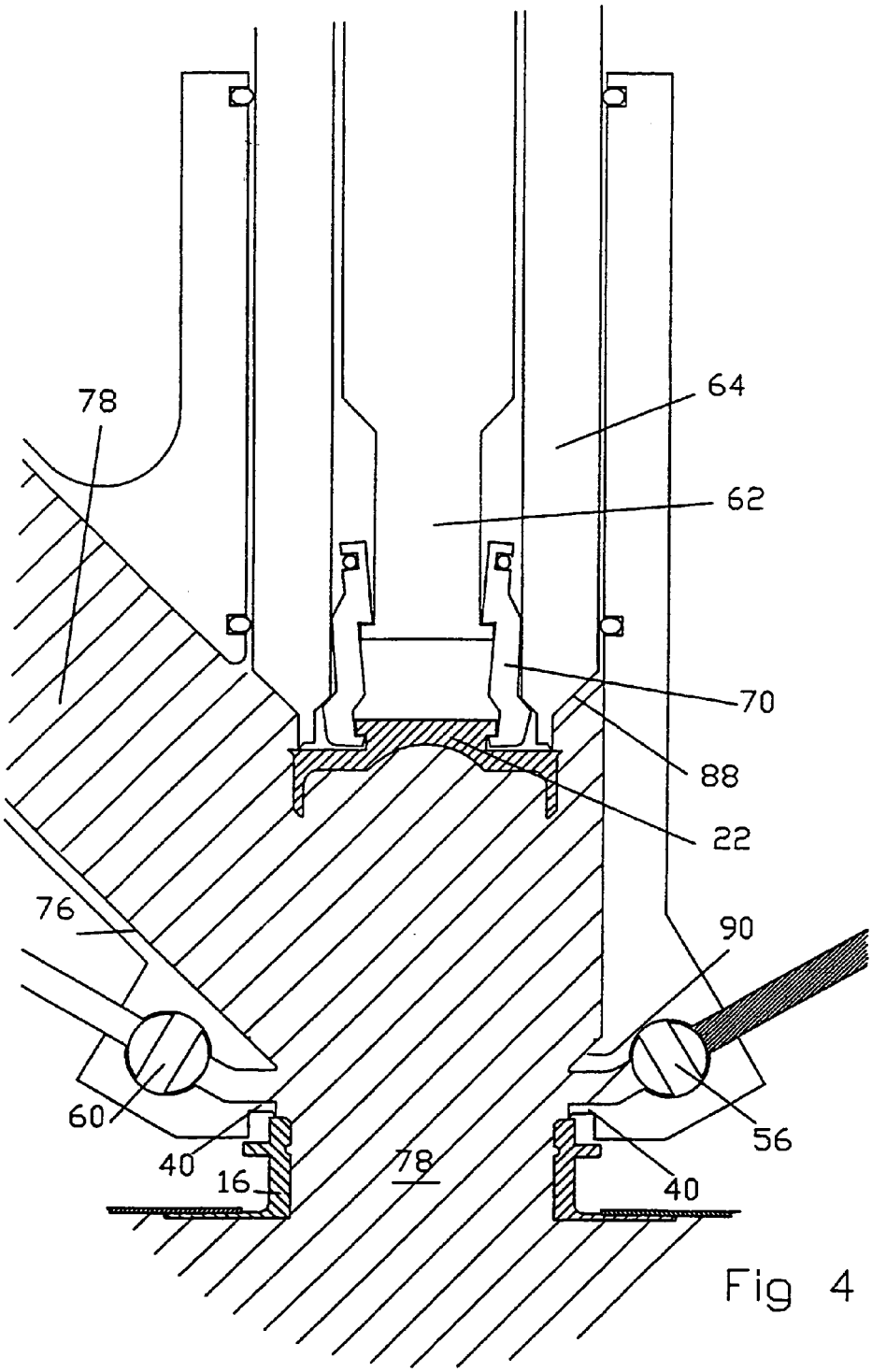
FIG. 4 shows a similar view to that of FIGS. 2 and 3 with the plug removed from the tubular body of the transfer port and with filling material being introduced to the container.

Once sterilization has taken place, and this will generally take between two and five seconds at 150° C., the sleeve 64 will begin moving upwardly and in so doing the plug 22 will be pulled out of the tubular body 16 to the position shown in FIG. 4 of the drawings. As shown in FIG. 4, the plug 22 is suspended in a cavity within the sealing head above the tubular body 16 and the supply passage is opened.

The product 78 to be filled into the container will then be supplied through the supply passage 76, the product 78 passing down the flow passage 19 and into the container. It will be noted that the product 78 comes into contact with the underside of the plug 22 as well as the skirt portion of the plug 22. However, the product does not come into contact with any surface which has not been rendered bacteria free as a consequence of either sterilization during manufacture of the container or the sterilization operation referred to above. Thus, the product will in no way be contaminated during the filling process. Provided the product itself is bacteria free at the time it is introduced into the container it should receive no bacteria contamination during the filling process and should therefore be bacteria free within the container.

Figure 5:
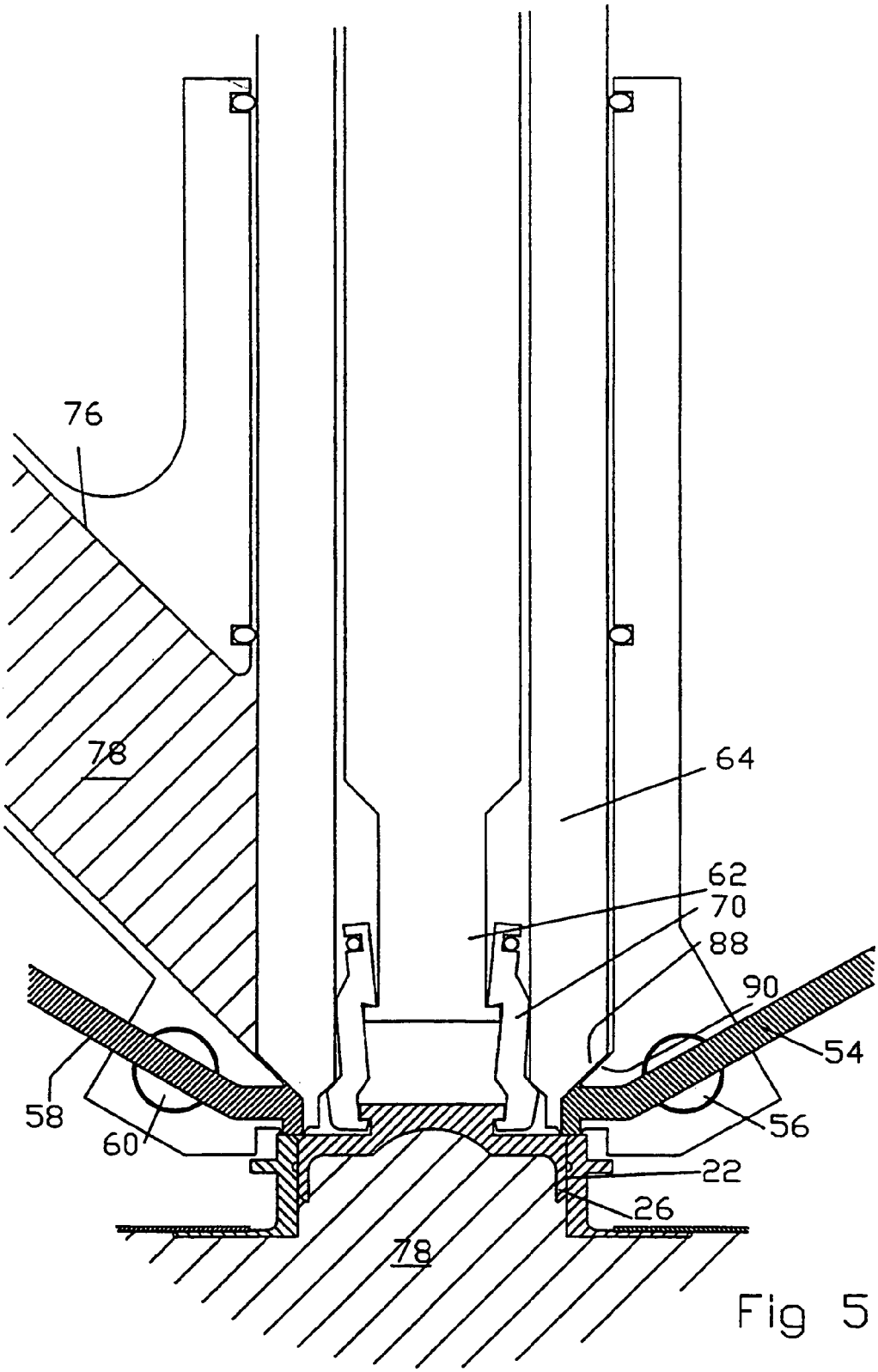
FIG. 5 shows a similar view to that of FIG. 3 but with the inlet partially closed by the plug partially inserted into the inlet and with sterilization fluid being used to flush and clean the plug.

Once the container is filled, the plug 22 will be replaced into the tubular body 16. This process is shown in FIG. 5 of the drawings. As shown, the plug 22 is pressed into the tubular body so that the skirt 26 enters and engages with the cylindrical surface 18. At this point, it will be noted, the ports 56 and 60 have again been opened so that steam flushes through the sterilization chamber as the plug is being closed.

Described below is an arrangement in which the steam which is used to evacuate the sterilization chamber after closure of a plug may be used to clean substantially the entire outer surface of the plug as the plug is being introduced into the passage 19.

In the embodiment shown in FIG. 5, however, the steam will clean and evacuate the sterilization chamber and upper surfaces of the plug and tubular body between the outer and inner sealing rings.

Figure 6:
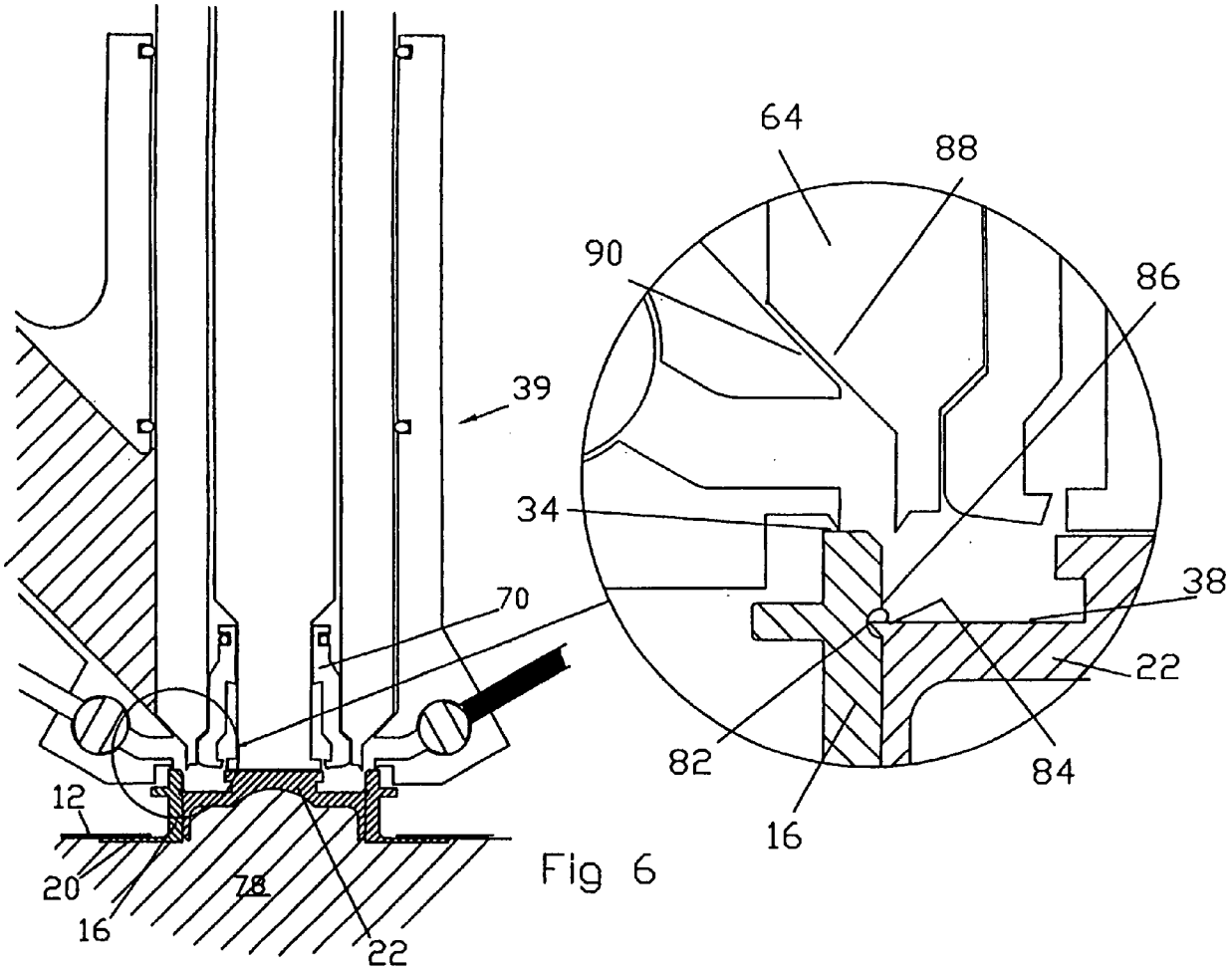
FIG. 6 shows a similar view to that of FIG. 5 with the plug fully inserted into the tubular body.
Figure 7:
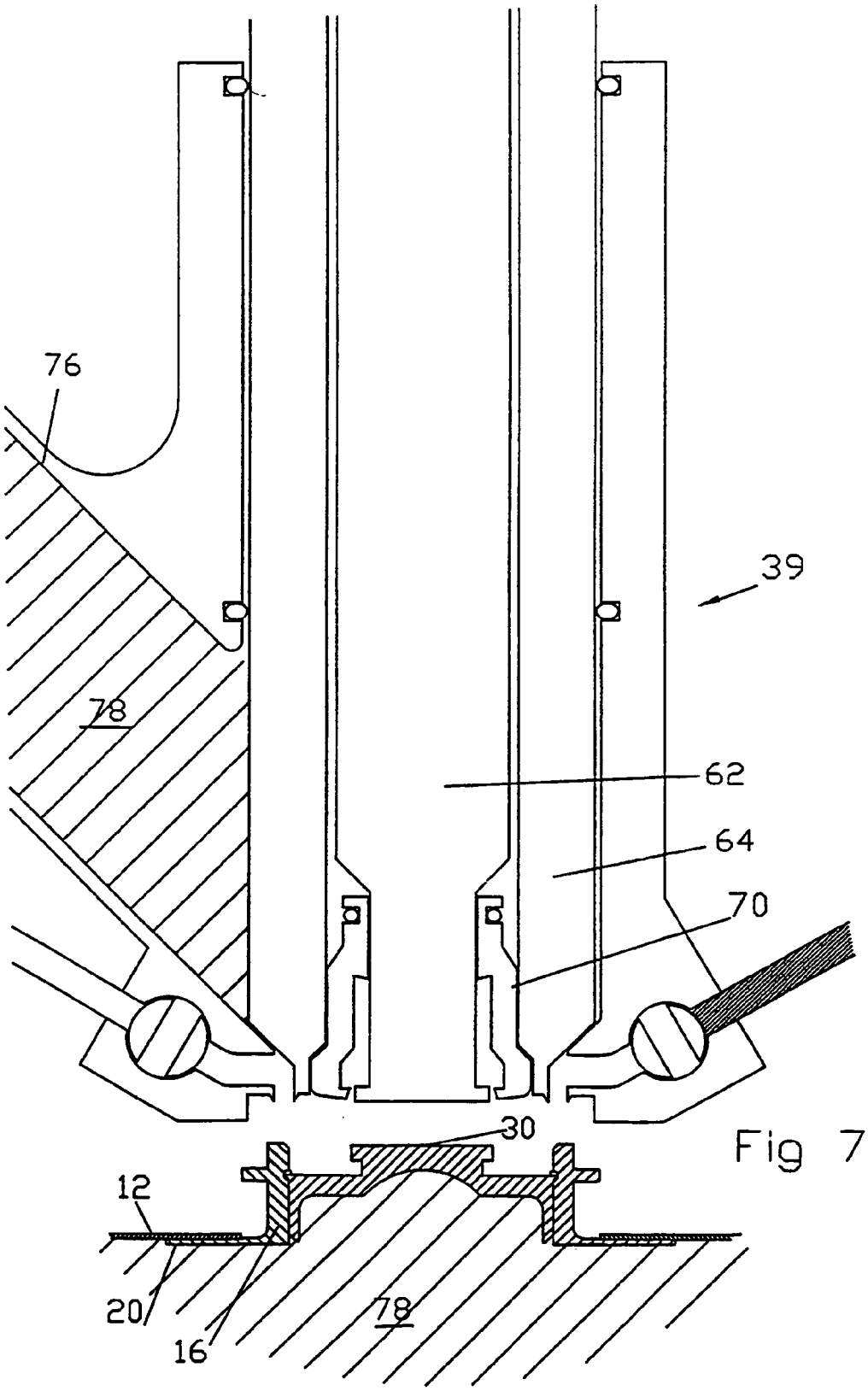
FIG. 7 shows the sterilization and filling head and the transfer port separated from each other.
Figure 8:
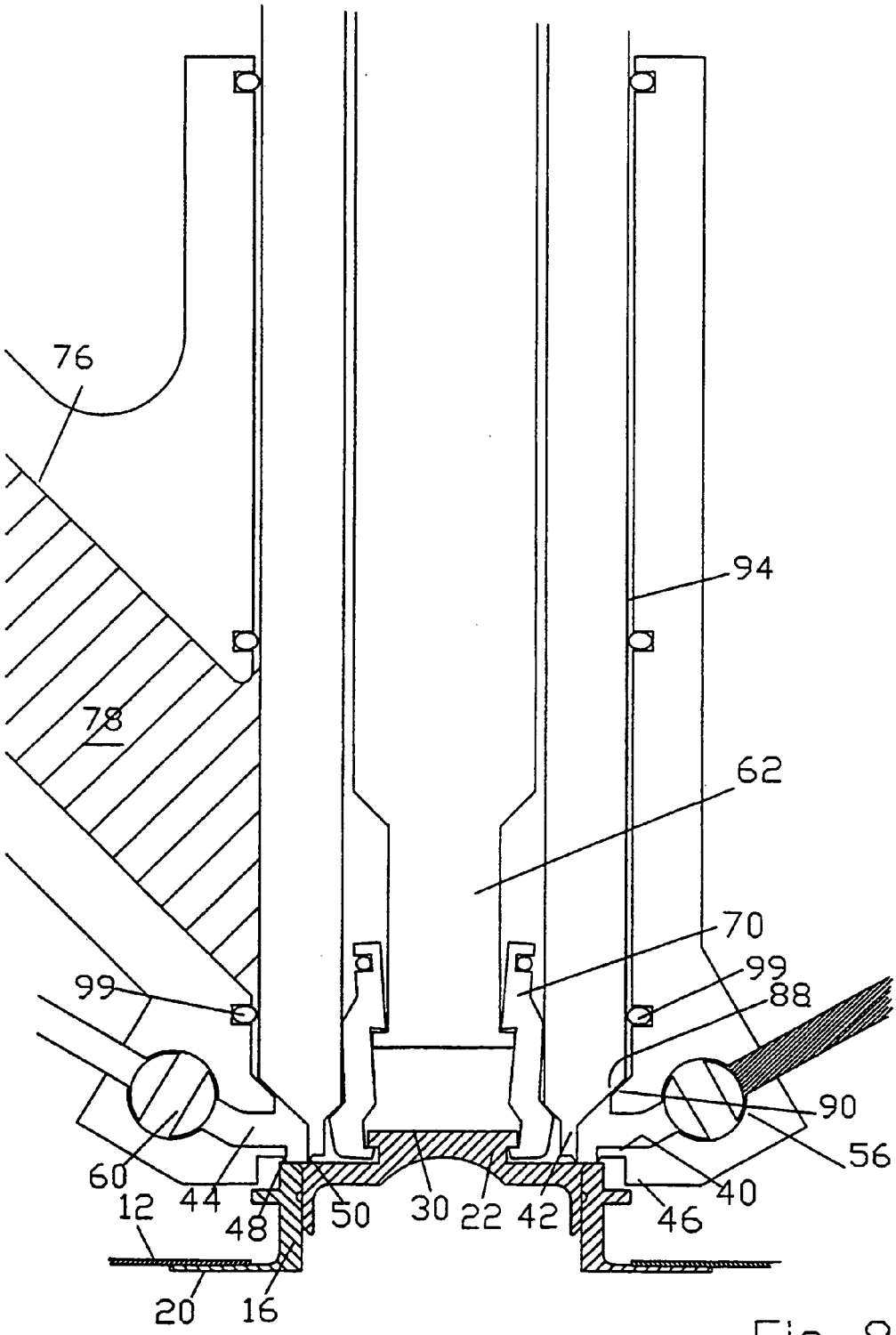
FIG. 8 shows a cross-sectional side of a second embodiment of sterilization and filling head with the transfer port in engagement with the head.
Figure 9:
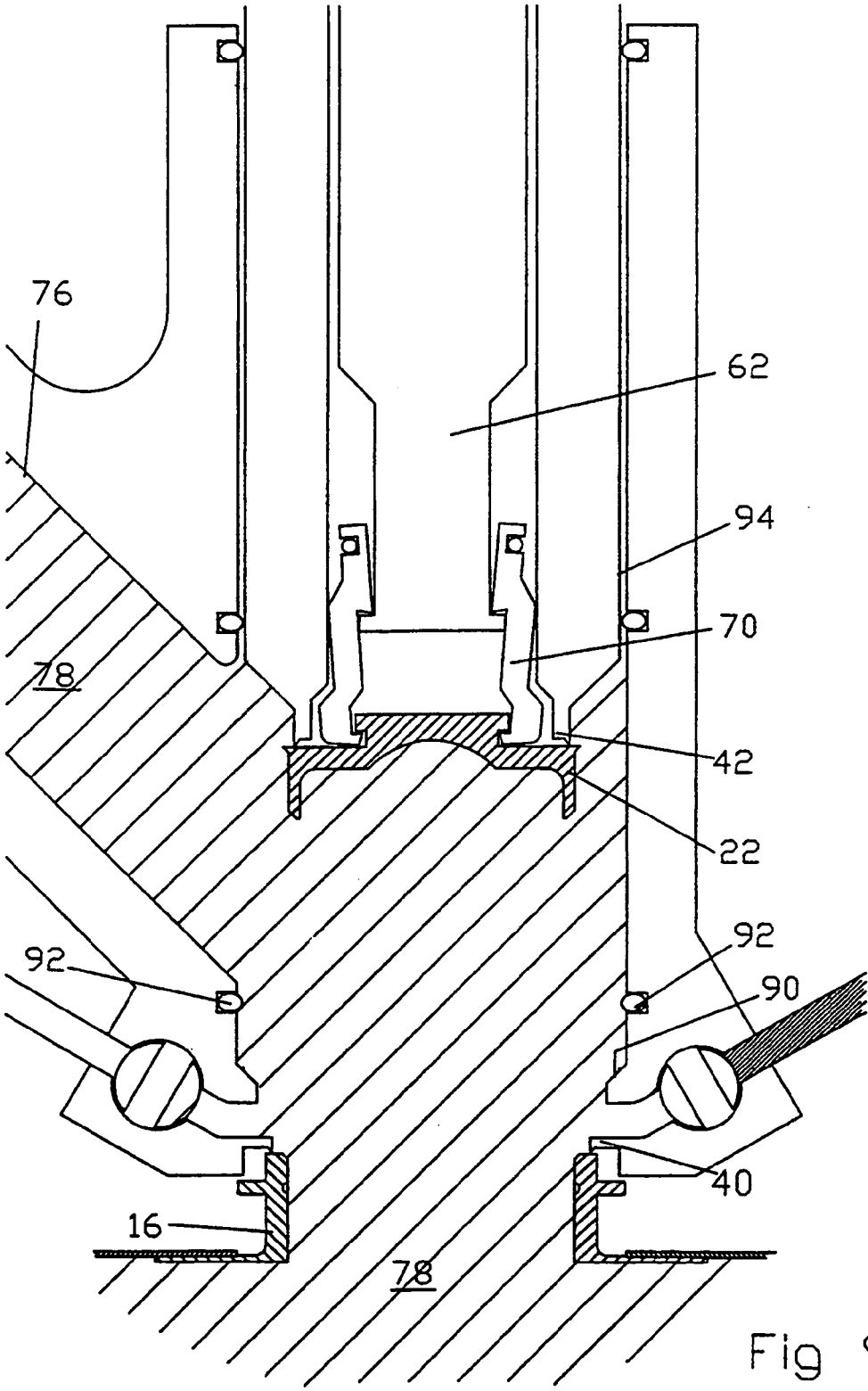
FIG. 9 shows a similar view to that of FIG. 8 with the plug lifted out of the tubular body.

Once the transfer port has been cleaned in the manner described and depicted in FIG. 5, the plug can be pushed further into the passage 19 as indicated in FIG. 6 of the drawings. It will be noted that the inner wall 18 of the tubular body has an annular groove 82 which lies just below the sealing surface 34. The plug has an outwardly directed lip 84 on its outer edge and when the plug is pressed into the passage 19 so that the surface 38 lies below the surface 34 the lip 84 will locate in the groove 82 to provide a locking arrangement between the plug and the tubular body. Optionally the groove 82 may have an annular elastomeric seal 86 located therein and the lip 84 will engage with that seal 86 to form a bacteria proof sealing arrangement.

It will be noted that as the ram 52 moves the plug inwardly from the position shown in FIG. 5 to the position shown in FIG. 6 the jaws 70 will automatically disengage from the head 30 to allow the plug 22 to be pressed further into tubular body 16.

It will be noted that towards the lower end of the sleeve 64 a tapered or bevelled sealing surface 88 is formed. This sealing surface 88 is adapted to engage and seal with a seat 90 which is defined within the sterilization and sealing head just above the sterilization chamber. When the sleeve 64 moves to a closed position, as shown in FIG. 5, the surface 88 will engage and seal with the seat 90 to form a fluid tight seal. It is envisaged that this seal will be metal to metal seal or some other form of hard seal which will form a positive stop for the downward movement of the sleeve 64. This will allow the sleeve 64 to be moved up and down using pneumatics.

The hard seal will serve to sever or shear any particulate materials that might otherwise be trapped as the sleeve 64 moves to the closed position.

Clearly there may be many forms of interlocking arrangements which may be provided between the plug and the tubular body. What is important is that no micro passageway exists for the passing of microorganisms between the plug and the tubular body which could otherwise compromise the integrity of the seal provided between the plug and the tubular body.

Alternative arrangements for sealing the plug in the tubular body include some form of welding system. For example, either the plug or the tubular body, or both, may be formed of a material which will soften in the presence of the high temperature sterilization fluid and, when so softened, weld the plug and the tubular body together as the plug is fully inserted into the tubular body to thereby form a seal between these two components which is bacteria proof. It will also be possible to provide a third component which will melt in the presence of the high temperature steam and form a bacteria proof seal between the plug and the tubular body. Some form of hot melt adhesive, for example, coated onto the outer surface of the skirt 26 could achieve the desired welding type seal arrangement. These aspects are discussed in more detail below.

Turning now to FIGS. 8 to 11 of the drawings, a second embodiment to the invention is shown which is similar to that of the first embodiment except for a difference in the manner in which the sleeve 64 serves to close off the flow of product through the supply passage 76. In this description parts which are similar to or the same as those referred to in the previous embodiment have been given the same numbers. These parts will not be described again.

Figure 10:
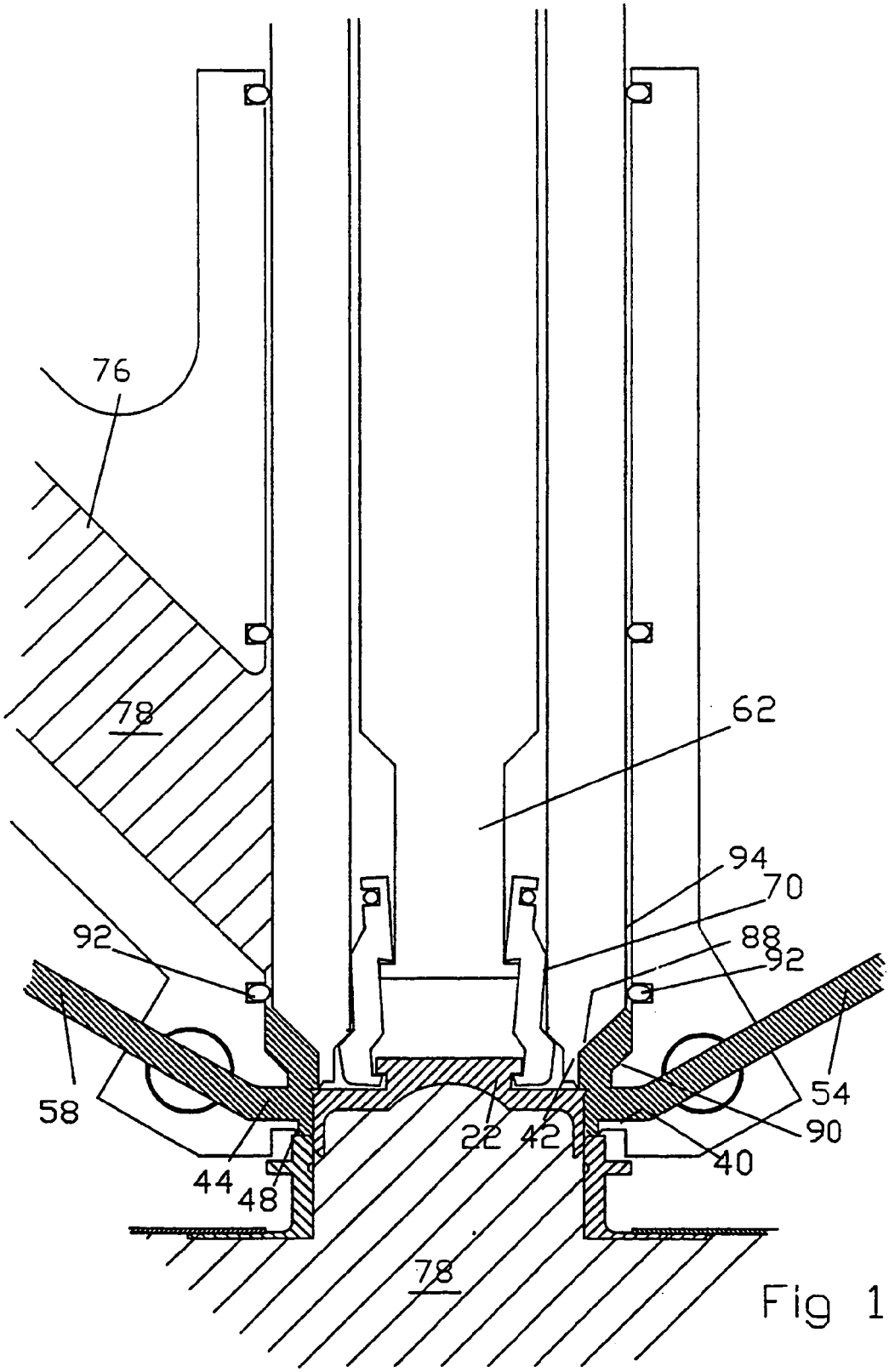
FIG. 10 shows a similar view to that of FIGS. 8 and 9 with the plug partially closed.
Figure 11:
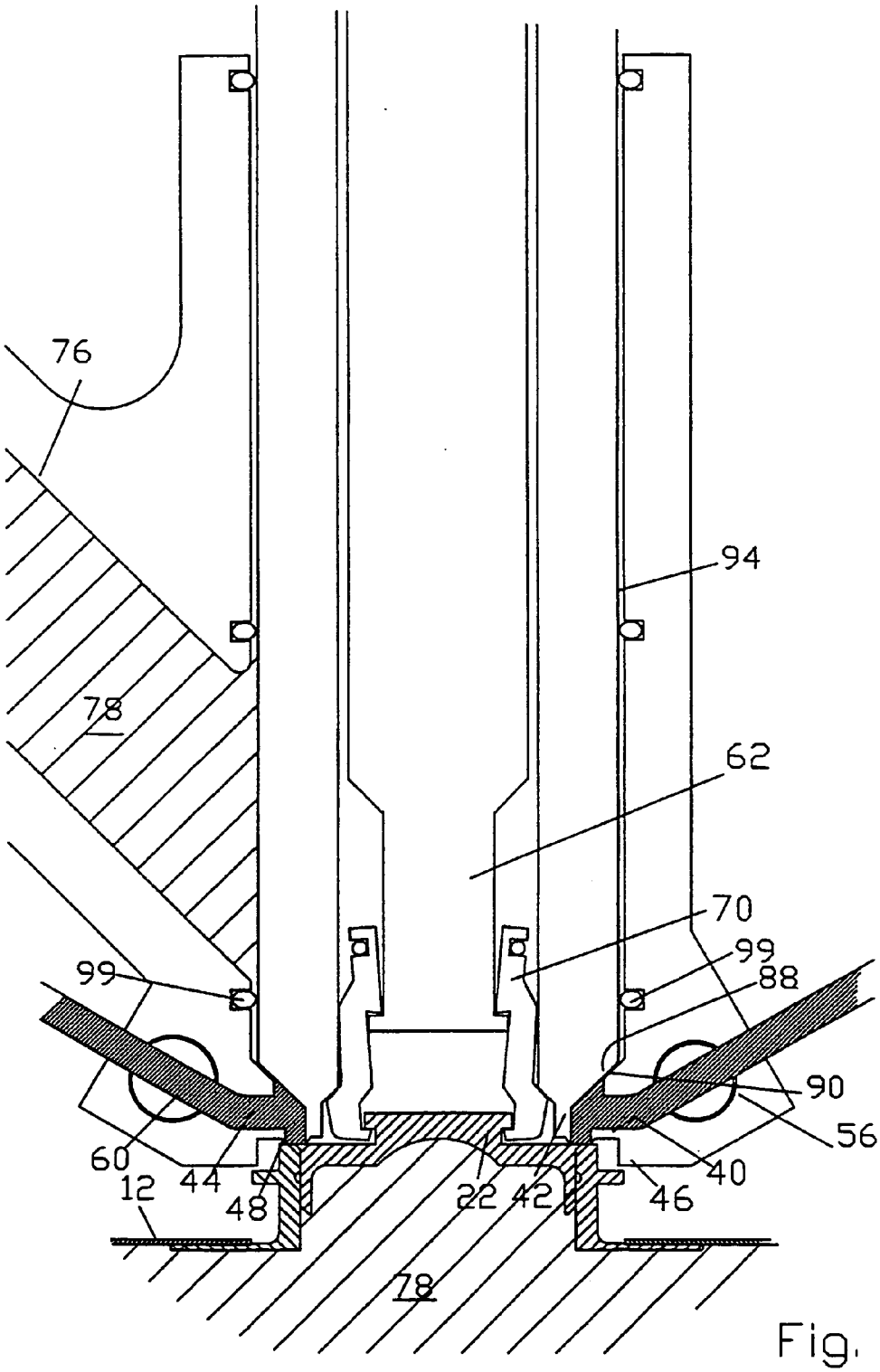
FIG. 11 shows a similar view to that of FIG. 8 but with the plug fully closed.

As shown, the sleeve 64 has a sealing surface 88 on the lower end thereof which is adapted to seal with a correspondingly tapered seat 90 on the sealing head. However, seat 90 has been spaced some distance lower than that of the previous embodiment. The sterilization and filling head in this embodiment is provided with an additional sliding seal 92 which is adapted to seal with the outer surface 94 of the sleeve 64 as the sleeve 64 moves down towards its closed position. Thus, as the sleeve moves downwardly from the open position shown in FIG. 9 to the partially closed position shown in FIG. 10, the outer surface 94 of the sleeve 64 will engage the sliding seal 92 to close off the flow of product prior to the tapered sealing surface 88 contacting the seat 90. This has the advantage that steam under pressure, as shown in FIG. 10, can be introduced into the sterilization chamber 44 prior to the plug 22 being fully inserted into the tubular body 16. As shown clearly in FIG. 10, the skirt 26 of the plug 22 is exposed in the partially closed position shown in FIG. 10 so that the other surface 28 of the skirt can be cleaned by sterilization fluid, generally steam. It is envisaged that in a partially closed position shown in FIG. 10 steam will be introduced into the sterilization chamber 44 to clean substantially all product off the outer surface 28 of the plug 22. Thus, when the plug is fully inserted into the tubular body 16 as shown in FIG. 11, the surface 28 will have been cleaned and therefore micro passages which might otherwise have remained as a consequence of a product being trapped between the surfaces 28 and 18 will to a substantial extent be eliminated.

A further advantage of clearing the surface 28 of the plug 22 with high pressure, high temperature steam is that where it is desired to weld the plug 22 into the tubular body 16 the steam will serve to soften the outer surface of the plug. These two components will then weld together when the plug is in its closed position.

Turning now to FIG. 12, FIG. 13, FIG. 14, FIG. 15 and FIG. 16 of the drawings, a sterilization and filling head similar to the previous embodiment is shown which is also used to close off the flow of product into the container prior to the plug being fully closed.

In this embodiment, the sterilization and filling head 98 has a moveable sleeve 100 which is used to lift the plug 22 out of the tubular body 16 and also serves to open and close the filling passage 76. The sleeve 100 is formed of an inner sleeve 102 and outer sleeve 104 which are moveable relative to each other. The inner sleeve 102 has a sharp lower edge 106 which is adapted to engage the sealing surface 38 on the plug 22. The outer sleeve 104 has a bevelled lower edge 108 which is arranged to engage and seal with the seat 90 of the sterilization and filling head. A sliding seal 110 seals the gap 112 between the inner sleeve 102 and outer sleeve 104.

Figure 12:
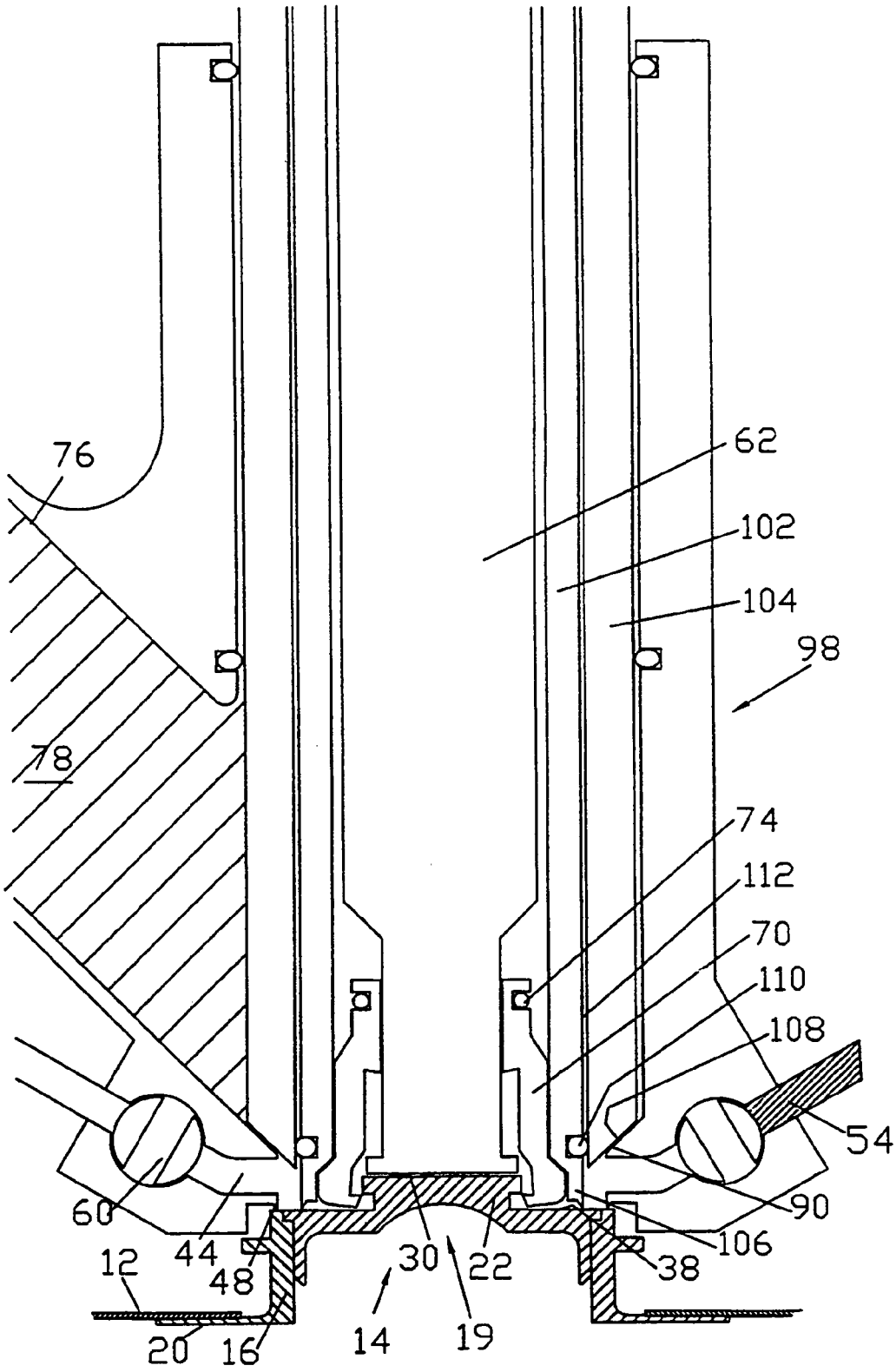
FIGS. 12 to 16 show cross-sectional side views of a third embodiment of sterilization and filling head according to the invention in engagement with a transfer port in different stages of the sterilization and filling operation.

Illustrated in FIG. 12, the ram 62 is shown in an extended position relative to the gripping jaws 70. This keeps tips 71 of the gripping jaws 70, which engage the undercut 32 of plug 22, in an unengaged position whereby the tips 71 are clear of the undercut 32.

Figure 13:
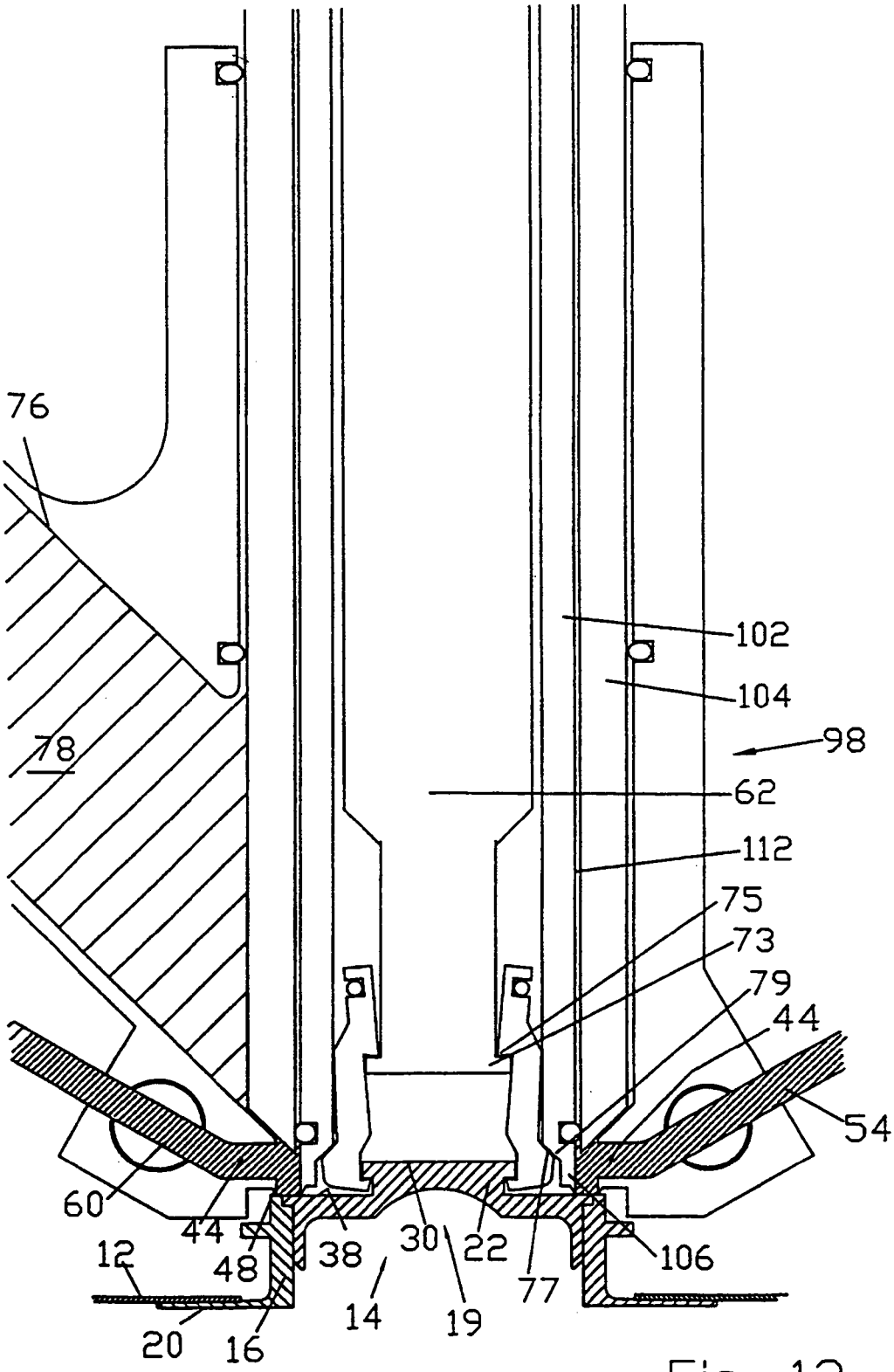

As illustrated in FIG. 13, as the ram 62 is retracted, a flange 73 on its lower end engages an internal shoulder 75 on the jaws 70. This moves the jaws 70 axially away from the tubular body 16 which forces ramps 77 on each of the jaws 70 to engage ramps 79 on the inner sleeve 102. This forces the tips 71 to engage the plug beneath the undercut 32.

In the condition illustrated in FIG. 13 sterilization fluid enters the sterilization chamber 44 as in the embodiment of FIGS. 2 to 7 or 8 to 11.

Figure 14:
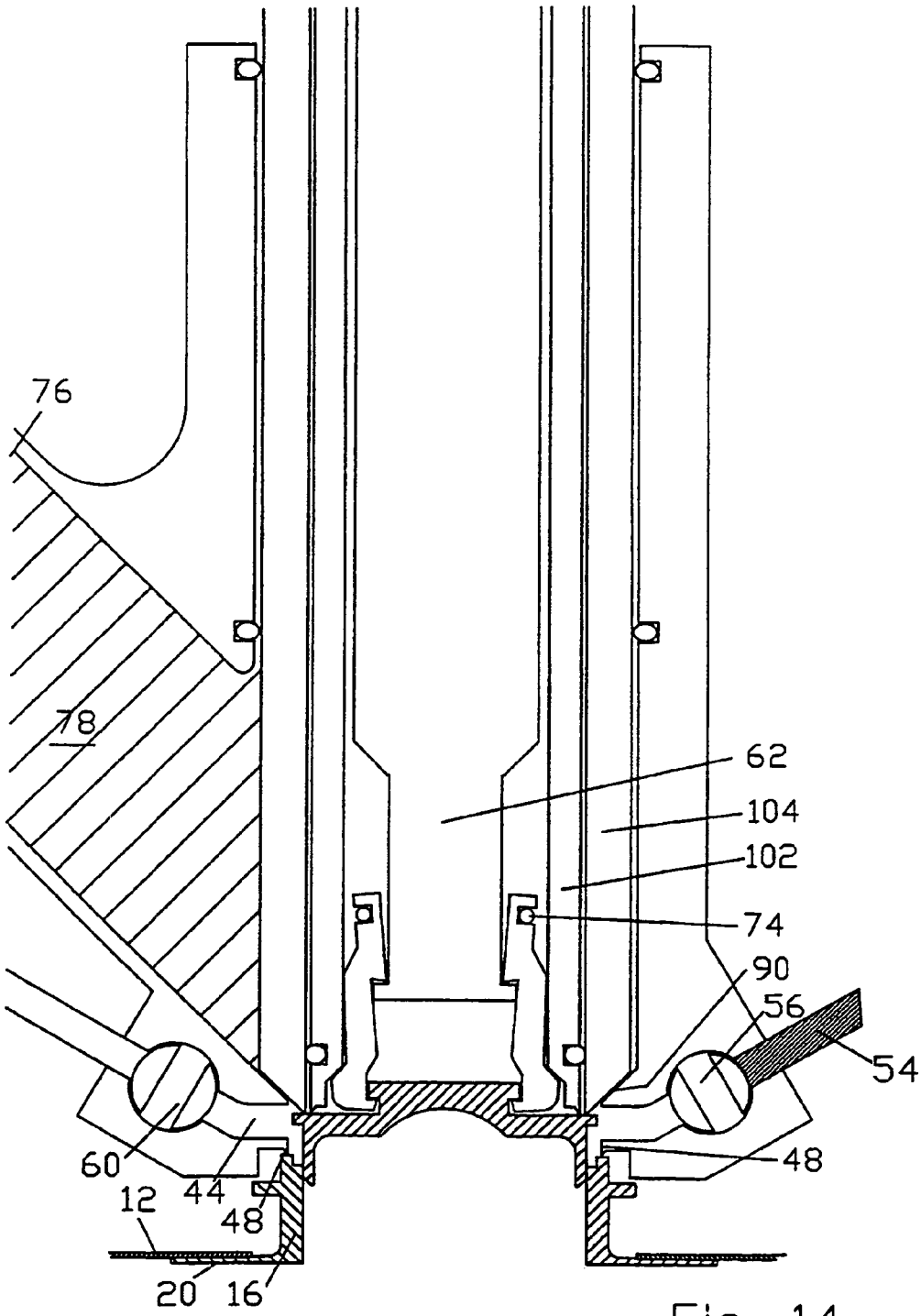
Figure 15:
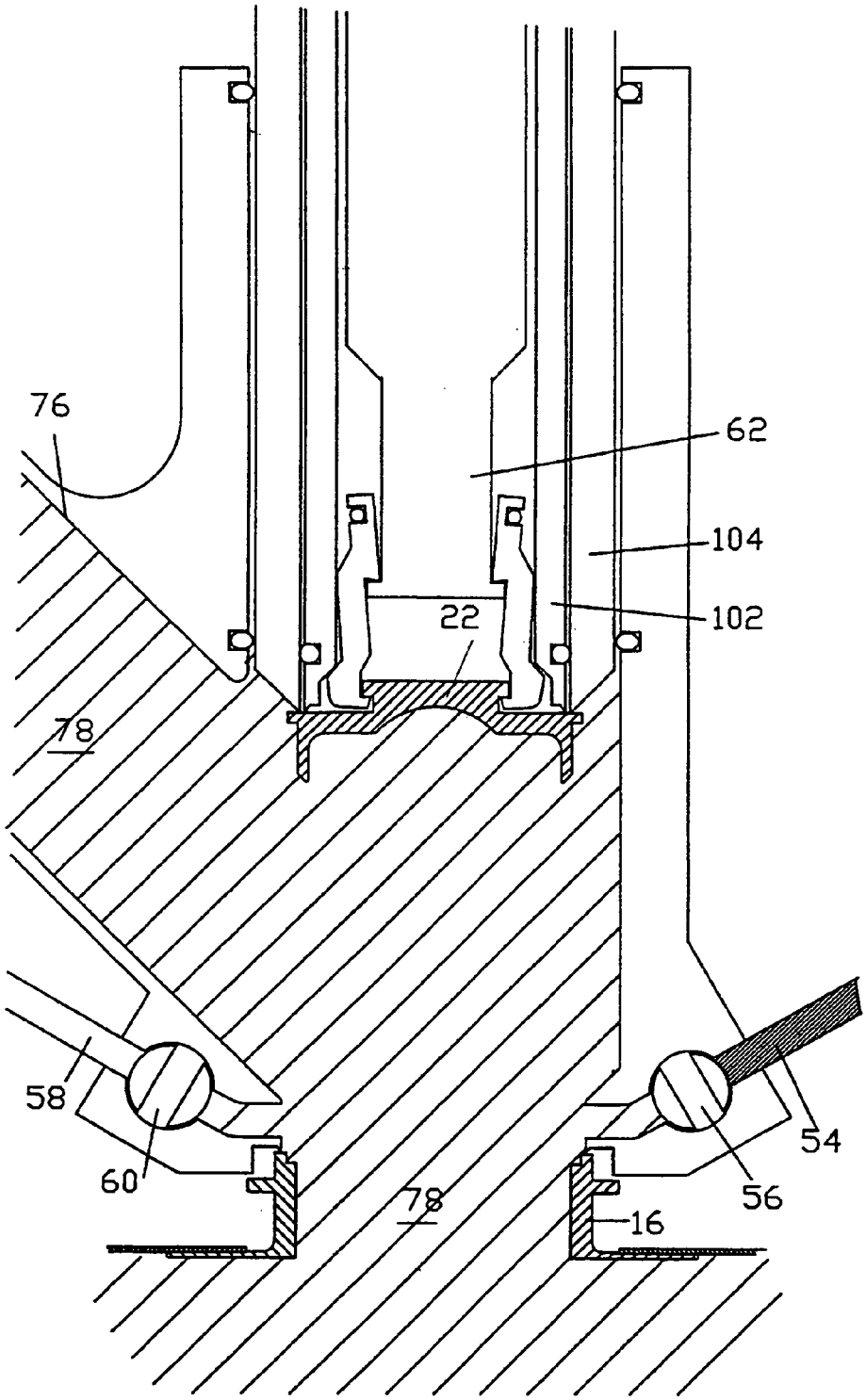

Once sterilization of the portions of the plug 22 and tubular body 16 which are exposed in sterilization chamber 44 has been completed, the inner sleeve 102, ram 62 and plug 22 are retracted together until the outer surface 38 of plug 22 engages the extremity of ramps 79 as seen if FIG. 14. With each of items 104, 102, 62 and 22 maintaining their positions relative to each other, the sleeve 104, sleeve 102, ram 62 and plug 22 are retracted in unison to the positions as illustrated in FIG. 15. This is the most preferred method of retraction as it minimizes the amount of outer surface 38 of plug 22 which will be exposed to the product 78 flowing thereover. This will thus decrease the possibility of contamination.

A less preferred retraction scheme is to allow the sleeve 104, sleeve 102, ram 62 and plug 22 to retract in unison in the positions as illustrated in FIG. 13. Then once the sleeve 104 has retracted to its fullest extent this will leave the plug 22 somewhat occluding the passage of the product 78. So as to minimize the occlusion, the sleeve 102, ram 62 and plug 22 can be moved in unison relative to the sleeve 104 until the outer surface 38 of plug 22 engages the ramp 79 as illustrated in FIG. 15. Clearly, this has a greater probability of contaminant or food product being trapped between sleeves 102 and 104, but this contaminant will be cleared once flushing occurs just after the plug 22 is placed back in the gland 16.

If desired the circumference of the plug 22 can be decreased or the internal diameter of the sleeve 104 increased so that the plug 22 can move into the sleeve 104 and thus produce a circumferential seal around the plug 22. This will ensure that no part of the surface 38 will be able to hold particulate. To do this an interference fit between the plug 22 and sleeve 104 is preferred but not to a degree which will make the removal of the plug 22 from the sleeve 104 difficult.

Once the outer sleeve 104 has retracted to fully open the passage 76, as illustrated in FIG. 14, the inner sleeve and plug 22 are potentially occluding the passage 76. If the opening is not sufficient, the inner sleeve 102 and ram 62 move together until such time as the upper surface of the plug 22 engages the bevelled lower edge lower edge of the outer sleeve 104, as is illustrated in FIG. 15. If desired, this step of having the upper surface of plug 22 engaging the bevelled lower edge of the outer sleeve 104 can be done prior to the outer sleeve 104 disengaging from the tapered seat 90.

Once filling has been completed, the outer sleeve 104, inner sleeve 102 and ram 62 are moved together axially towards the tubular body 16.

Figure 16:
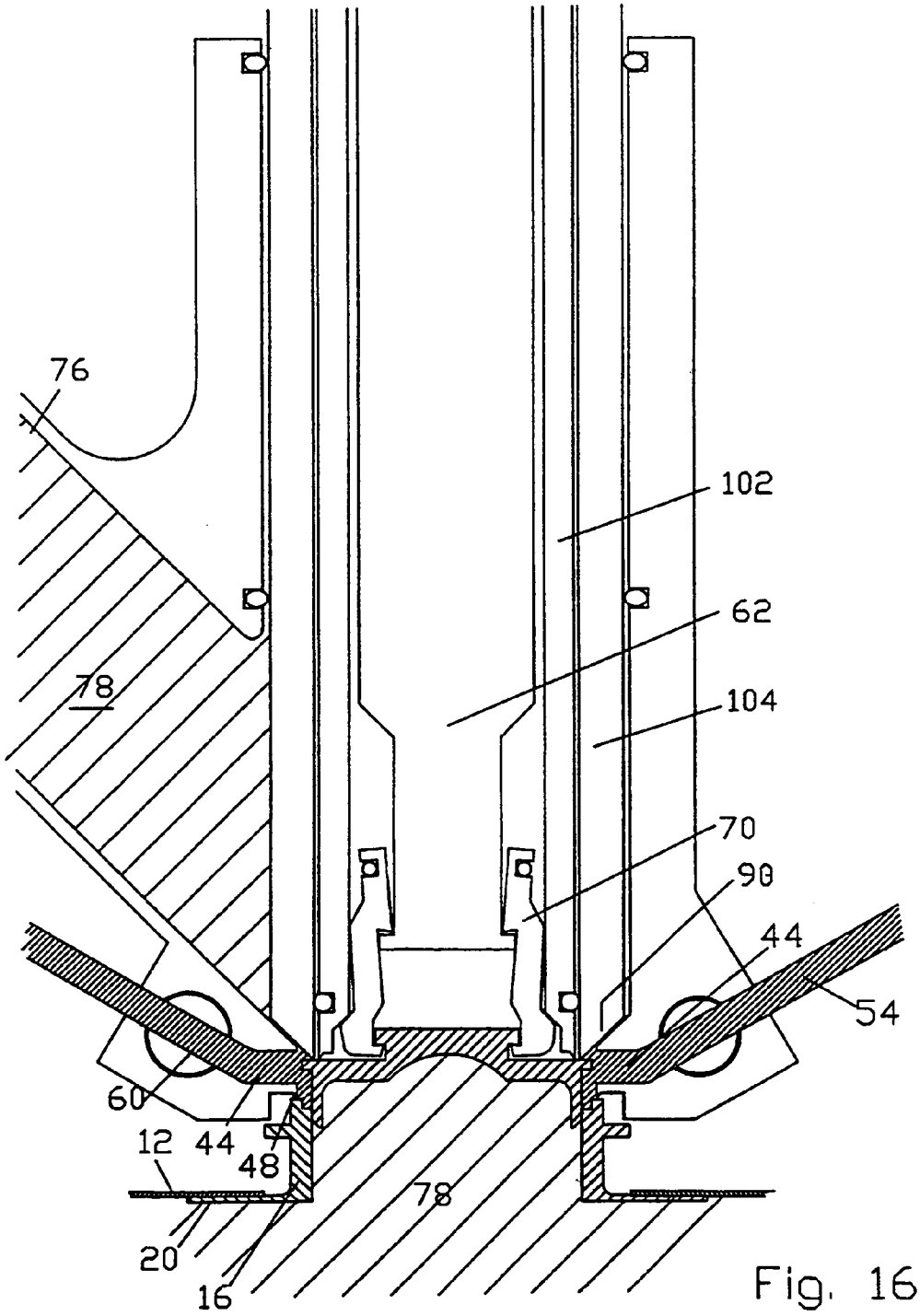

As illustrated in FIG. 16, once the outer sleeves 104 closes passage 76 by engaging tapered seat 90, the inner sleeve and ram have stopped simultaneously therewith.

At this point, as illustrated in FIG. 16 the valve 56 is opened so as to introduce sterilizing fluid into the sterilizing chamber 44.

The sterilizing fluid will sterilize and flush any food product which remains in the sterilizing chamber 44 to thereby clean the side surfaces of the plug 22 prior to closing.

The exposure to the side surfaces of the plug 22 to the temperature of the sterilizing fluid will soften them thereby helping to create a seal when the plug 22 is pushed into the tubular body 16, as has been described with respect to the embodiment of FIGS. 2 to 7 or 8 to 11.

Clearly, by providing a facility whereby the inner sleeve 102 may be moved relative to the outer sleeve 104 the plug 22 can be moved to a partially open position, or a fully open position, when the outer sleeve is still in engagement with the seat 90, thereby closing off the filling passage 76.

Likewise, during the closing of the filling passage 76, the outer sleeve 104 can be first moved into a closed position against the seat 90 whilst the plug is in an open, or partially open condition. This will allow the outer surface of the plug 22 to be cleaned with sterilization fluid in a manner described above with reference to the previous embodiment. Clearly the ability to close the filling passage 76 using the outer sleeve 104 whilst being able to independently manipulate the plug 22 may be advantageous in certain circumstances.

Turn now to FIG. 17, FIG. 18, FIG. 19 and FIG. 20 of the drawings. Various different types of transfer port arrangement are shown in these figures. Clearly these are not the only kinds of transfer ports which might be used but these four embodiments do show the types of ports which might be considered for different applications.

Figure 17:
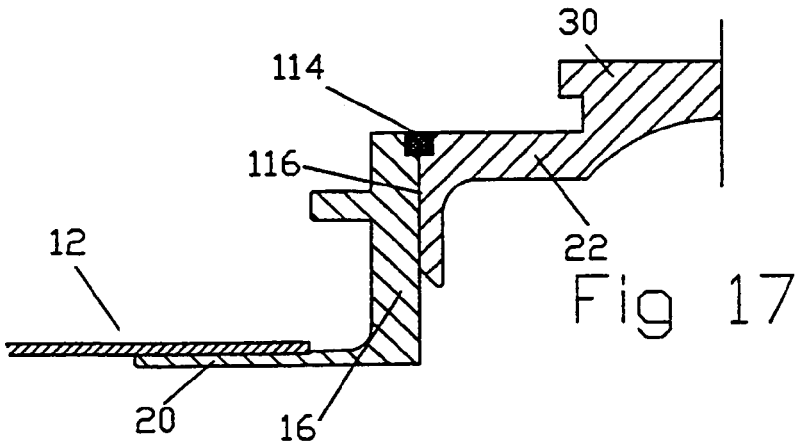
FIGS. 17 to 20 show cross-sectional side views of different embodiments of transfer port according to the invention.

Turning first to FIG. 17, it will be noted that the plug 22 and transfer port 16 have a seal 114 therebetween which will seal off the gap 116 between the plug 22 and transfer port 16. The seal 114 will, it is envisaged, be adapted to melt, or at least soften when heated by the sterilization fluid. Thus, when sterilization of the transfer port 16 is taking place prior to the plug 22 being removed from the tubular body 16, the seal 114 being exposed to hot sterilization fluid, will melt, and the plug 16 may thereafter be extracted from the tubular body 16. The seal 114 will, however, have ensured that no contaminating microorganisms could have entered into the gap 116 between the plug 22 and tubular body 16.

Figure 18:
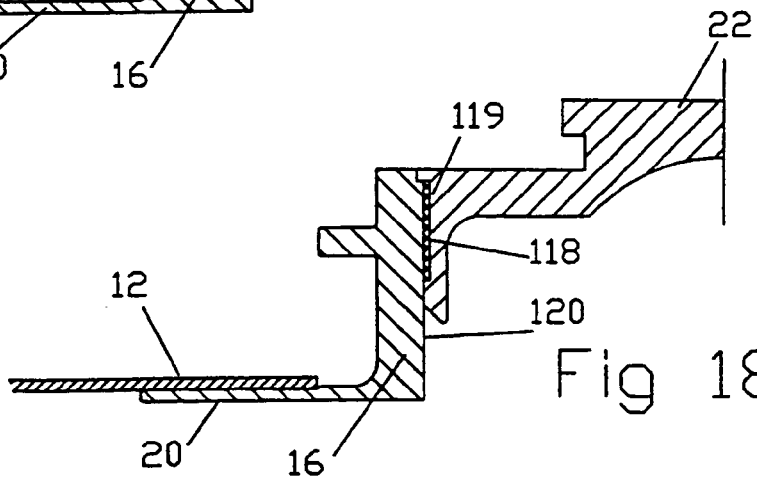

A different seal arrangement is shown in the right hand side of the FIG. 18 embodiment. In this arrangement an outer surface 119 of the plug 22 has an adhesive material 118 coated on the thereon which is adapted to bond to the inner surface 120 of the tubular body 16. Thus, when the outer surface 119 of the plug 22 is heated during the closure operation, as described above with references to the second and third embodiments of the invention, this adhesive material 118 will soften so that when the plug 22 is closed, as shown in the FIG. 18 drawing, adhesive 118 will bond to the surface 120. This will form a permanent bond between the plug 22 and tubular body 16 thereby ensuring that the seal between two components will not be compromised after the container has been filled.

Figure 19:
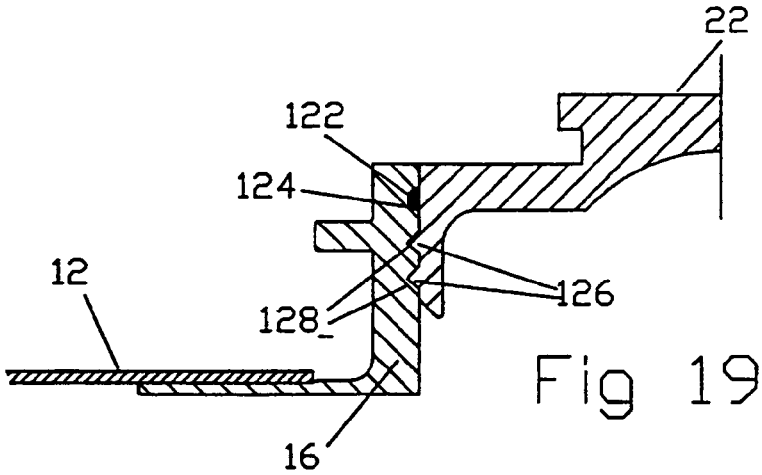

The embodiment shown in FIG. 19 is similar to that shown in FIG. 1. The seal is achieved by an elastomeric seal 122 which is located in a groove 124 formed in the inner wall of the tubular body 16. The elastomeric seal 122 may be adapted to bond with the outer wall of the plug 22, particularly where the plug 22 has been heated during the closing operation. The plug 22 also has a pair of outwardly directed ribs 126 which are located in corresponding grooves 128 formed in the inner wall of the tubular body 16.

Figure 20:
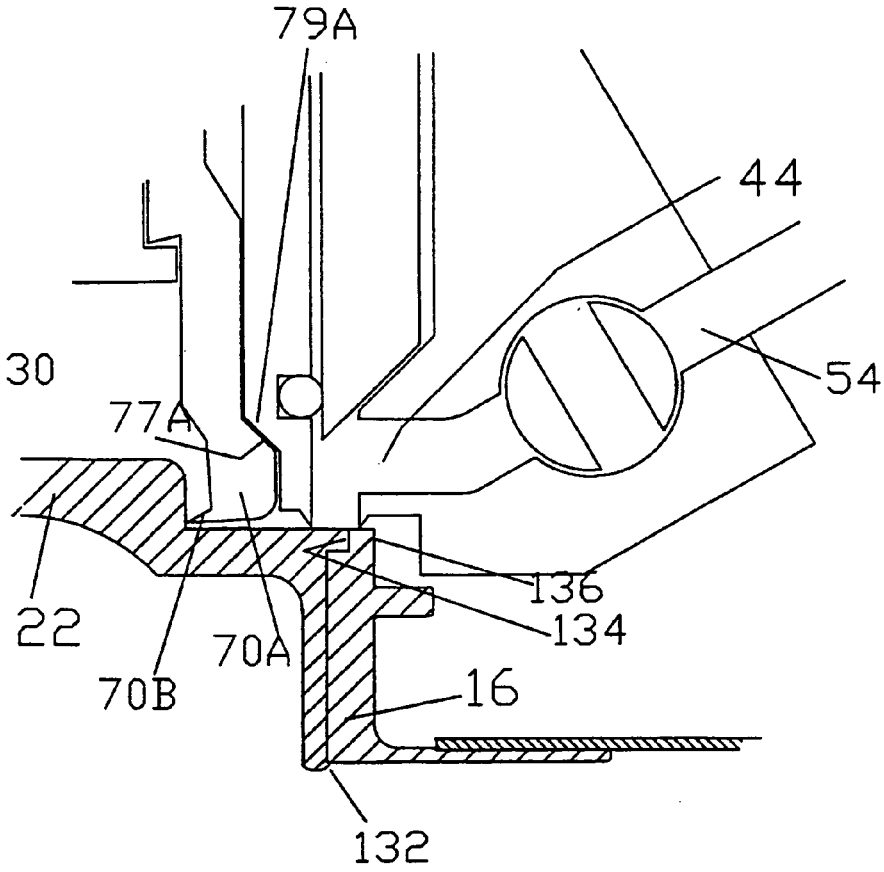

In the embodiment shown in FIG. 20, the plug 22 has a relatively deep skirt 130 having an outwardly directed flange 132 on the lower edge thereof and an outwardly directed flange 134 on the upper edge thereof which locates in a recess 136 formed in the tubular body 16. Provided the plug 22 is a tight sliding fit within the tubular body 16, the combined effect of the flange 132 and 134, and the lengthy face to face contact between the plug 22 and the tubular body 16 should ensure that the seal between the plug 22 and the tubular body 16 is not compromised. Also, the outwardly directed flange 132 will have a wiping effect as the plug 22 is inserted into the tubular body 16 to ensure that the inner surface of the tubular body 16 is relatively free of product when the plug 22 is inserted into the tubular body 16. The outer surface of the plug 22 may also be cleaned during the insertion process to ensure that both surfaces are substantially free of product when the plug 22 is fully inserted into the tubular body 16.

The upstanding head 30 of the plug 22 of FIG. 20 does not include an undercut 32 as do the other embodiments previously described. In FIG. 20, the head 30 is engaged by a claw 70A having a sharp projection 70B at its terminus. The projection 70B will be forced into the material of the head 30 when the jaws 70A are moved axially away from the tubular body 16 causing the ramp 77A to engage ramp 79A thus forcing the projection 70B in the direction of the head 30.

In the above described embodiment when sealing of the plug 22 within the gland 16 after the container has been filled, it is best to ensure than contaminants do not enter the container along a pathway defined at the interface between the gland 16 and the plug 22. However, it is also important that the plug 22 is relatively easily removable from the gland 16 for filling purposes. Also, after the container has been filled, it is important that the plug 22 is relatively easily insertable into the gland 16 and, once inserted, is relatively easily removable from the gland 16 in order to decant the contents of the container through the gland 16.

Whilst it is possible to form both the plug 22 and the gland 16 to relatively close tolerances, it is unsafe to rely only on those close tolerances to ensure that the integrity of the seal between the plug 22 and the gland 16 is maintained. Also, if the fit between the plug 22 and the gland 16 is made too tight then insertion of the plug 22 into the gland 16, and the subsequent removal of the plug 22 from the gland 16, are made that much more difficult and can lead to failure of the system either on closing or on opening which, in turn, can lead to loss of contents of the container.

Typically the container and gland 16 will be sterilized internally after manufacture, generally by ionizing radiation. It is essential in a practical sense that the interior of the container is maintained in a sterile condition prior to being filling so that material introduced into the container is introduced into a sterile environment. To aid in this maintenance of sterility the embodiments of FIGS. 21 to 24 will be of assistance.

Figure 21:
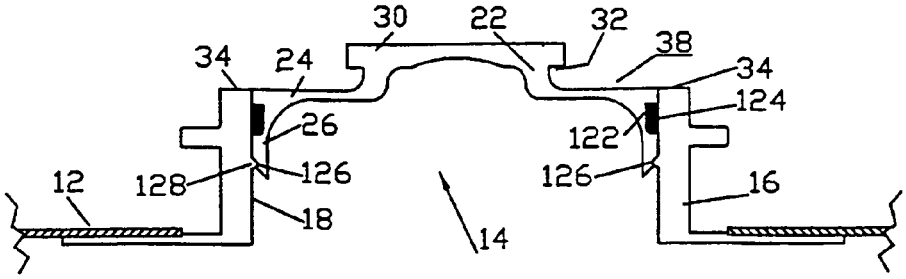
FIG. 21 shows a cross-sectional side view through a plug and gland port according to the invention prior to filling.
Figure 22:
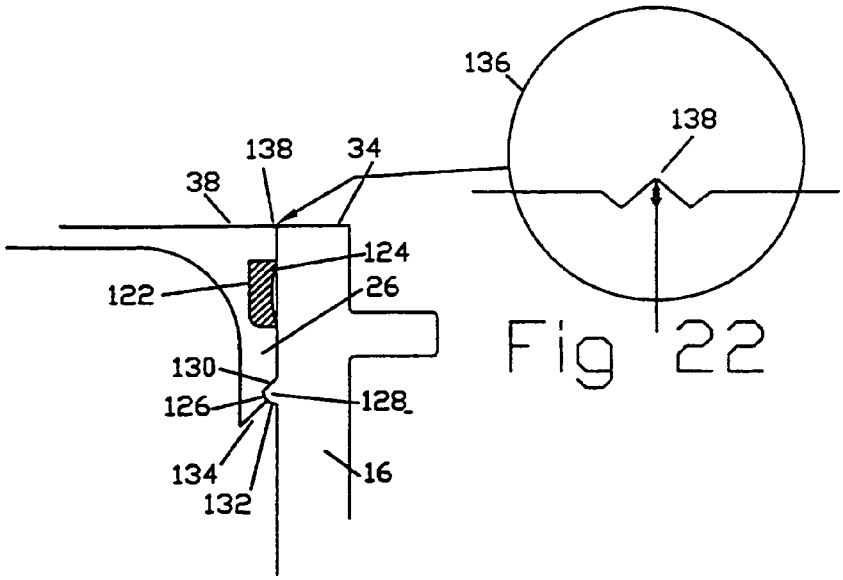
FIG. 22 shows an enlargement of the interface between the plug and gland in the position shown in FIG. 21.

As shown in FIG. 21 and 22, a plug and gland port includes a gland 16 and a plug 22. The gland 16 is comprised of a tubular body which defines a passage 14 therethrough and has an inner cylindrical wall 18. The gland 16 is fitted to a wall of a container and fluid material is introduced through the passage 14. The gland 16 has an outer end face 34 and an outwardly directed rib 120 extends around the periphery of the gland. The rib 120 serves to strengthen the gland and ensure that it does not deform during the filling process or when the plug 22 is inserted into or removed from the gland 16.

The plug 22 includes an end wall 24 and a skirt 26, the outer surface of this skirt 26 being a close sliding fit with the cylindrical wall 18. The plug has an upstanding head 30 which is undercut as shown at numeral 32 so that the plug can be gripped and removed from the gland 16 or reinserted into the gland 16 as required.

The radially outer surface of the skirt 26 has a first annular recess 122 formed therein which is filled with an elastomeric sealing ring 124. The sealing ring 124 is preferably formed of a low melt point sealant such as polyolefin elastomer.

The plug 22 and the gland 16 need not be formed of the same material. The gland may, for example, be formed of polyethylene and the plug may be formed of a material such as polypropylene.

The skirt 26 has a second annular recess 126 formed therein located on the radially outer surface of the skirt near the innermost end thereof.

The wall 18 of the gland 16 has an annular rib or lip 128 formed therein which is best seen in FIG. 2 of the drawings. It will be noted that the rib 128 has a generally triangular form in cross section so that the outwardly facing surface 130 and the inwardly facing surface 132 both have a tapered or bevelled configuration to facilitate the engagement of the rib 128 in the groove 126. It will be noted that the end 134 of the skirt 26 is also of tapered or bevelled configuration to facilitate the insertion of the skirt into the gland.

In the position shown in FIGS. 21 and 22 the end face 38 of the plug 22 is flush with the outer end face 34 of the gland 16. This will be the condition prior to the container 12 being filled with material.

If necessary, the plug and the gland may be sealed together, prior to filling, by providing a temporary weld or seal as shown at detail 136 in FIG. 22. As is known in the art, the interior of the bag, and the interior of the gland, are sterilized after manufacture by an appropriate sterilization technique, typically radiation. To ensure the integrity of the seal prior to filling the interface between the plug 22 and the gland 16 may be shaped and welded together as indicated in detail 136 to thereby define a frangible weld 138 at the interface. When it is desired to fill the bag the plug 22 will be removed from the gland 16, breaking the weld 138. However, during filling the region will first have been sterilized in the manner described above with reference to FIGS. 1 to 20.

Figure 23:
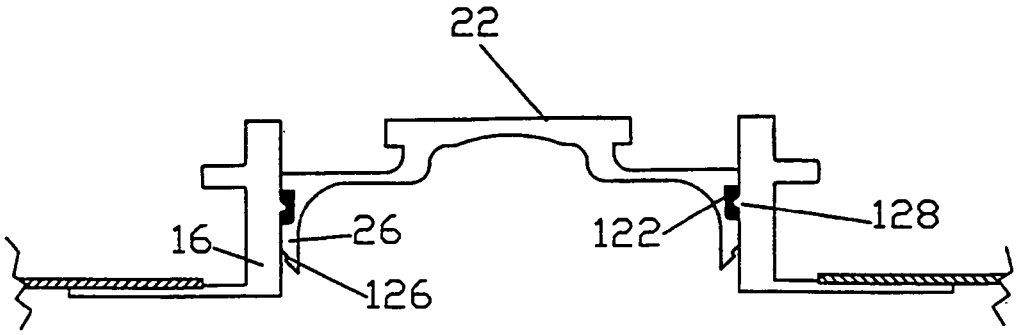
FIG. 23 shows a cross-sectional side view of the plug and gland port after the container has been filled.
Figure 24:
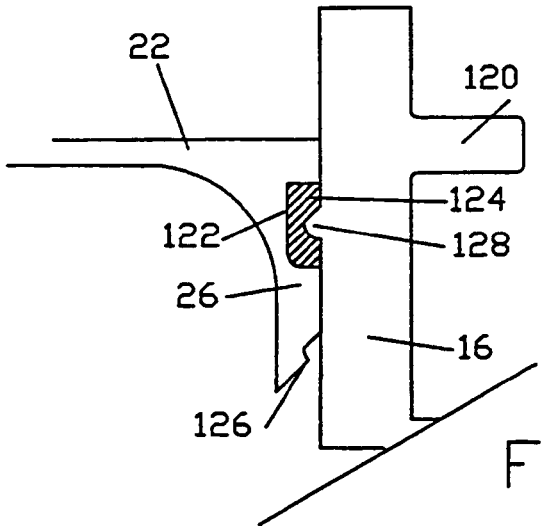
FIG. 24 shows an enlargement of the interface between the plug and gland in the position shown in FIG. 23.

After the bag has been filled the plug will be reintroduced into the gland 16, but will be pushed further into the gland, to the position shown in FIGS. 23 and 24 of the drawings. In this position the recess 122 will be located adjacent the rib 128 so that the rib 128 embeds itself within the elastomeric sealing ring 124.

Preferably the elastomeric sealing ring 124 ring will have been heated during the closing procedure by sterilization steam introduced against the elastomeric sealing ring 124 after the plug has been partially introduced into the gland. This procedure is described in detail above.

After the elastomeric sealing ring 124 has been heated the plug 22 will be pushed further into gland 16 to the position shown in FIGS. 23 and 24 wherein the rib 128 is embedded within the elastomeric sealing ring 124. In this position, the elastomeric sealing ring will cool, and at least partially solidify to thereby lock and seal the plug 22 within the gland 16. The material from which the elastomeric sealing ring 124 is made will therefore preferably be of a type which will partially melt plasticize at steam temperature in a relatively short period of time.

To remove the plug from the gland 16 the plug will be gripped and pulled outwardly thereby breaking the seal between the sealant 124 and the rib 128.

There may be various alterations to the above-described embodiment without departing from the scope of the invention. For example, there may be a plurality of ribs 128 with a corresponding plurality of recesses 122, each filled with a suitable sealant 124 to thereby improve the integrity of the seal. Similarly, the materials from which the plug, the gland, and the sealant are made could vary from that described herein. Also, necessary variations will need to be made where different packaging systems are employed.

It should be understood in this specification that the terms "up", "down", or "above" and "below" are not intended to indicate that the filling operation must be conducted in a particular orientation. Those terms are simply intended to assist with the description of the preferred embodiments and indeed it is envisaged that the system could well be used to fill horizontally or vertically or at an inclined angle. These terms should therefore not be in any way limiting on the ambit of the invention.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

What is claimed is:

1. A method of aseptically filling an internally sterilized sealed container having a transfer port which comprises a tubular body which is sealed to the wall of the container and defines a flow passage therethrough, and a sealing plug engaged into the passage, the tubular body having an annular outer sealing face thereon which surrounds the flow passage, and the plug having a grippable formation and a sealing face surrounding the grippable formation, the method comprising the steps of:

supporting the tubular body of the container in a selected orientation and position;

providing a sterilization and filling head having at least an outer sealing ring thereon which is adapted to engage and seal with the annular outer sealing face, an inner sealing ring and a sterilization chamber located between and at least partially defined by the outer sealing ring and the inner sealing ring;

bringing the sterilization and filling head and the tubular body into engagement with each other so that the outer sealing ring engages and seals with the annular sealing face and the inner sealing ring engages and seals with the sealing face of the plug;

introducing a sterilization fluid into the sterilization chamber to sterilize at least the radially outer part of the plug and that part of the tubular body between the outer and inner sealing rings;

gripping the grippable formation and withdrawing the grippable sealing plug out of the tubular body in a direction away from the container whilst maintaining the outer sealing ring in sealed contact with the sealing face and the inner sealing ring in sealed contact with the sealing face of the plug;

introducing a flowable material into the container through the tubular body;

reinserting the plug into the tubular body to thereby close the tubular body; and disengaging the sterilization and filling head and the tubular body from each other.

2. A method as claimed in claim 1, wherein the method includes the steps of:

providing a gripping jaw on the sterilization and filling head within the outer sealing ring; and gripping the plug with the gripping jaw in order to withdraw the plug from the tubular body.

3. A method as claimed in claim 2, wherein said method includes the steps of:

gripping the grippable formation on the plug with the gripping jaw; and extracting the plug from the tubular body whilst urging the inner sealing ring in sealing engagement with the sealing face on the plug.

4. A method as claimed in claim 1, wherein the method includes the steps of:

partially inserting the plug into the tubular body;

cleaning the peripheral outer surfaces of the plug prior to fully inserting the plug into the tubular body; and fully inserting the plug into the tubular body.

5. A method as claimed in claim 4, wherein the step of cleaning the peripheral outer surfaces of the plug is achieved by introducing a sterilization fluid into the sterilization chamber with the plug partially inserted into the flow passage in the tubular body.

6. A method as claimed in claim 1, wherein the method includes the step of sealing the plug to the tubular body during or after the plug has been reinserted into the tubular body.

7. A method as claimed in claim 6, wherein the sealing is achieved by welding the plug in to the tubular body.

8. A method as claimed in claim 7, wherein the welding is done using one of the following: high temperature sterilization fluid; steam.

9. A method of aseptically filling an internally sterilized sealed container from a sterilizing and filling head through a transfer port of the container, the transfer port comprising a tubular body sealed to a wall of the container and defining a flow passage therethrough, and a removable sealing plug engaged in said flow passage and having a grippable formation and an annular sealing face surrounding the grippable formation, the tubular body having an exterior sealing surface, and the sterilization and filling head comprising an outer sealing ring and an inner sealing ring, the method comprising:

supporting the tubular body of the container in a selected orientation and position;

bringing the sterilization and filling head into engagement with the container such that the outer sealing ring engages and seals with the sealing surface of the tubular body and the inner sealing ring engages and seals with the annular sealing face of the plug such that the inner and outer sealing rings and the portion of the transfer port extending therebetween at least partially define a sterilization chamber;

introducing a sterilization fluid into the sterilization chamber;

gripping the grippable formation and withdrawing the sealing plug out of the tubular body whilst maintaining the outer sealing ring in sealed contact with the tubular body and whilst maintaining the inner sealing ring in sealed contact with the sealing face of the plug;

introducing a flowable material into the container through the tubular body;

reinserting the plug into the tubular body to thereby close the tubular body; and disengaging the sterilization and filling head from the container.

10. A method of aseptically filling an internally sterilized sealed container from a sterilizing and filling head through a transfer port of the container, the transfer port comprising a tubular body sealed to a wall of the container and defining a flow passage therethrough, and a removable sealing plug sealing said flow passage, the sealing plug having a side wall engaged into the passage, the tubular body having an exterior sealing surface, the sterilization and filling head including an outer sealing ring, the method comprising:

supporting the tubular body of the container in a selected orientation and position;

bringing the sterilization and filling head into engagement with the container such that the outer sealing ring engages and seals with the sealing surface of the tubular body, the portion of the transfer port within the outer sealing ring providing a surface of a sterilization chamber;

introducing a sterilization fluid into the sterilization chamber to sterilize the surfaces of the sterilization chamber;

withdrawing the plug out of the tubular body whilst maintaining the outer sealing ring in sealed contact with the tubular body;

introducing a flowable material into the container through the tubular body;

partially reinserting the plug into the tubular body such that a portion of the plug side wall remains exposed to the sterilization chamber;

cleaning the exposed surfaces of the partially inserted plug;

completing the insertion of the plug into the tubular body to thereby close the tubular body; and disengaging the sterilization and filling head from the container.

11. A method of aseptically filling an internally sterilized sealed container from a sterilizing and filling head through a transfer port of the container, the transfer port comprising a tubular body sealed to a wall of the container and defining a flow passage therethrough, and a removable sealing plug engaged into the passage in an initial rupturable sealed position, the tubular body having an exterior sealing surface, the sterilization and filling head comprising an outer sealing ring, the method comprising:

supporting the tubular body of the container in a selected orientation and position;

bringing the sterilization and filling head into engagement with the container such that the outer sealing ring engages and seals with the sealing surface of the tubular body, a portion of the transfer port within the outer sealing ring providing a surface of a sterilization chamber;

introducing a sterilization fluid into the sterilization chamber to sterilize the surfaces of the sterilization chamber;

withdrawing the plug out of the tubular body whilst maintaining the outer sealing ring in sealed contact with the tubular body;

introducing a flowable material into the container through the tubular body;

reinserting the plug into the tubular body into a second position deeper than the initial position to thereby seal closed the tubular body; and disengaging the sterilization and filling head from the container.

12. A sterilization and filling apparatus for aseptic filling of sterile containers having a filling nozzle comprising a tubular body with a flow passage therethrough and a plug for closing the flow passage, at least the tubular body having an annular sealing face thereon, and the plug having a grippable formation and a sealing face surrounding the grippable formation, the apparatus comprising:

holding means for holding the container and/or the tubular body in a selected position;

a sterilization and filling head having at least an outer annular sealing ring adapted to engage the annular sealing face on the tubular body and an inner sealing ring located inwardly of the outer sealing ring and adapted to engage the sealing face of the plug, the sterilization and filling head having a sterilization chamber located between and at least partially defined by the outer and inner sealing rings, the sterilization and filling head having a cavity therein adapted to receive the plug of a container to be filled, the sterilization and filling head and/or the tubular body being movable towards and away from the other;

sterilization fluid supply means adapted to supply sterilization fluid to the sterilization chamber;

a plug extractor adapted to extract the plug from the tubular body and to move the plug into the cavity in the sterilization and filling head, the plug extractor including a gripper located inwardly of the inner sealing ring for gripping the grippable formation on the plug; and filling means adapted to fill the container through the sterilization and filling head when the plug has been extracted.

13. A sterilization and filling apparatus as claimed in claim 12, wherein the inner sealing ring is co-axial with said outer sealing ring and spaced inwardly therefrom to define an annular space therebetween, said annular space forming said sterilization chamber.

14. A sterilization and filling apparatus as claimed in 12, wherein the plug extractor may comprise one or more gripping jaws adapted to grip the plug and extract it from the tubular body into the cavity.

15. A sterilization and filling apparatus as claimed in claim 14, wherein the jaws are mounted to a ram which is moveable in an axial direction towards and away from the plug, the jaws being moveable between gripping and release positions.

16. A sterilization and filling apparatus as claimed in claim 15, wherein the jaws automatically move to a gripping position when the ram moves in a direction away from the plug, and move into the release position when the ram moves towards the plug.

17. A sterilization and filling apparatus as claimed in claim 15, wherein the ram is adapted to drive the plug into the tubular passage after the container has been filled.

18. A sterilization and filling apparatus as claimed in claim 17, wherein the sterilization and filling head is adapted to shut off the flow of filling material into the container prior to the plug being fully inserted into the tubular passage.

19. A sterilization and filling apparatus as claimed in claim 17, wherein said sterilization and filling head is adapted to clean the plug with sterilization fluid when the plug is partially re-inserted back into the tubular passage.

20. A sterilization and filling apparatus for aseptic filling of sterile containers having a filling nozzle comprising a tubular body with a flow passage therethrough and a plug for sealing closed the flow passage, the tubular body having an exterior sealing surface, the plug having a grippable formation and an annular sealing face, the apparatus comprising:

a sterilization and filling head comprising a cavity, an outer sealing ring adapted to engage the tubular body sealing surface of a container, and an inner sealing ring moveable within the cavity and adapted to engage the plug sealing face of the container, the inner and outer sealing rings at least partially defining a sterilization chamber therebetween, a sterilization fluid supply adapted to supply sterilization fluid into the sterilization chamber, a plug extractor moveable within the inner sealing ring to engage the grippable formation on the plug and to extract the engaged plug from the tubular body into the cavity whilst maintaining sealed contact between the inner sealing ring and the plug sealing face, filling means adapted to fill the container through the sterilization and filling head when the plug has been extracted, the plug extractor further being movable to reinsert the plug into the flow passage.

21. An apparatus according to claim 20 wherein the inner sealing ring is adapted to seal with the plug sealing face by at least partially penetrating the plug sealing face.

22. An apparatus according to claim 20 wherein said plug extractor moves within, and substantially independently of, said inner sealing ring such that as a plug is extracted from a container, the plug is urged more forcefully against the inner sealing ring.

23. An apparatus according to claim 20 wherein said inner sealing ring is mounted on a moveable sleeve and wherein said plug extractor is mounted within said sleeve in a manner such that the plug extractor can move independently of the sleeve.

24. An apparatus according to claim 23 wherein the sliding sleeve acts as a control valve for the filling means for controlling the flow of flowable material into a container engaged by the filling head.

25. A sterilization and filling apparatus for aseptic filling of sterile containers having a filling nozzle comprising a tubular body with a flow passage therethrough and a plug for closing the flow passage, the tubular body having an exterior sealing surface, the apparatus comprising:

a sterilization and filling head comprising a cavity, an outer sealing ring adapted to engage the tubular body sealing surface of a container, the outer sealing ring at least partially defining a sterilization chamber;

a sterilization fluid supply adapted to supply sterilization fluid into the sterilization chamber;

a plug extractor adapted to engage a plug and extract the engaged plug from the tubular body into the cavity; and filling means adapted to fill the container through the sterilization and filling head when the plug has been extracted;

wherein the plug extractor is adapted to re-insert the plug into the tubular body of a container after filling of the container into a position which is deeper than the initial position from which the plug was extracted.

26. A sterilization and filling apparatus according to claim 25 further comprising sealing means for sealing a re-inserted plug into the tubular body of a container.

27. A sterilization and filling apparatus for aseptic filling of sterile containers having a filling nozzle comprising a tubular body with a flow passage therethrough and a removable sealing plug sealing said flow passage, the sealing plug having a side wall engaged into the passage, the tubular body having an exterior sealing surface, the apparatus comprising:

a sterilization and filling head comprising a cavity, an outer sealing ring adapted to engage the tubular body sealing surface of a container, the outer sealing ring at least partially defining a sterilization chamber;

a sterilization fluid supply adapted to supply sterilization fluid into the sterilization chamber;

a plug extractor adapted to engage a plug and extract the engaged plug from the tubular body into the cavity; and filling means adapted to fill the container through the sterilization and filling head when the plug has been extracted;

wherein the plug extractor is adapted to partially re-insert the plug sidewall into the tubular body of a container after filling of the container such that a portion of the plug side wall remains exposed to the sterilization chamber; and wherein the apparatus is configured such that whilst maintaining the plug in a partially re-inserted position the sterilization fluid supply can clean the exposed surfaces of the partially inserted plug.

28. A plug and gland port for use on an aseptic container, said port comprising:

a tubular body having a flow passage therethrough defined by a cylindrical inner wall of the tubular body, and a plug for sealing the flow passage, the plug having gripping formations on the outer face thereof, and retaining means or formations thereon for locking the plug into the flow passage, said retaining means comprising an annular recess formed around the periphery of the plug, and an annular rib or lip formed around and standing proud of the cylindrical inner wall of the tubular body, the rib or lip adapted to locate in the recess to form a locating and/or sealing engagement with the recess when the plug is operatively installed within the tubular body, wherein the annular recess on the plug is at least partially filled with a sealing ring, and wherein said sealing ring is a low melt sealant deposited in said recess.

29. A plug and gland as claimed in claim 28, wherein the rib or lip on the cylindrical inner wall is spaced a first distance away from the operatively outer end face of the tubular body.

30. A plug and gland as claimed in claim 28, wherein said rib or lip has a generally triangular form in cross section so as to provide a chamfered or bevelled face in both an outwardly facing direction and an inwardly facing direction to allow for simplified engagement and disengagement of the plug with the gland.

31. A plug and gland port for use on an aseptic container, said port comprising:

a tubular body having a flow passage therethrough defined by a cylindrical inner wall of the tubular body, and a plug for sealing the flow passage, the plug having gripping formations on the outer face thereof, and retaining means or formations thereon for locking the plug into the flow passage, said retaining means comprising a first annular recess formed around the periphery of the plug, and an annular rib or lip formed around and standing proud of the cylindrical inner wall of the tubular body, the rib or lip adapted to locate in the first recess to form a locating and/or sealing engagement with the first recess when the plug is operatively installed within the tubular body, and wherein said plug has a second annular recess formed around the periphery thereof, said second annular recess being spaced from the first annular recess, the second annular recess being spaced a distance away from the operatively outer end face of the plug by a distance which is substantially the same as distance which the rib or lip is spaced away from the operatively outer end face of the gland so that when the rib or lip is located within the second annular recess the operatively outer end faces of the gland and the plug are substantially flush with each other.

32. A plug and gland as claimed in claim 31 whereby prior to filling the container the gland and plug are welded together.

33. An aseptic container adapted to be filled with a flowable material, the aseptic container having a filling opening comprising a tubular body having a flow passage therethrough, and a plug for sealing the flow passage, the plug having gripping formations on the outer face thereof, and retaining means or locking formations thereon for operatively or cooperatively locking the plug into the flow passage, wherein the plug is cup shaped having an end wall and a cylindrical skirt depending from the end wall, the end wall adapted to be outermost when the plug is inserted into the flow passage.

34. An aseptic container as claimed in claim 33, wherein the gripping formations are formed on the end wall and project in a direction which is opposite to that in which the skirt extends from the end wall.

35. An aseptic container as claimed in claim 34, wherein said gripping formations take the form of a head which stands proud of the end wall.

36. An aseptic container as claimed in claim 35, wherein said head is undercut to provide purchase for gripping jaws which are adapted to extract the plug from the flow passage.

37. An aseptic container as claimed in claim 33, wherein said locking formations comprise a radially outwardly projecting annular rib formed on the plug, said rib being adapted to located behind a shoulder, end face or within a groove formed in or adjacent the flow passage.

38. An aseptic container as claimed in claim 33, wherein said flow passage and/or the plug have an annular seal therein adapted to seal with a plug inserted into the flow passage.

39. An aseptic container as claimed in claim 33, wherein the plug and/or the tubular body are formed of a thermoplastic material adapted to bond together under temperatures of between about 130° C. and 180° C.

40. An aseptic container as claimed in claim 33, wherein the plug and the tubular body are sealed together during manufacture.

41. An aseptic container as claimed in claim 40, wherein said seal is mechanically rupturable.

42. An aseptic container as claimed in claim 40, wherein said seal is adapted to be weakened under temperature of between 130° C. and 180° C. thereby providing an arrangement for simplified extraction of the plug after it has been sterilized by a high temperature sterilization fluid.

43. An aseptic container adapted to be filled with a flowable material from a filling and sterilization head of a filling apparatus, the aseptic container having a filling opening providing an exterior sealing surface for sterilization by the filling and sterilization head, the filling opening comprising:

a tubular body having a flow passage therethrough;

a plug for aseptically sealing the flow passage, the plug having at least one engageable formation adapted to be engaged by an engaging device of the filling head for removing and replacing the plug;

a first rupturable seal for aseptically sealing the plug within the flow passage and for maintaining the interior of the container in an aseptic condition prior to filling, and a sealing and retaining formation for aseptically sealing and retaining the plug within the flow passage and for maintaining the interior of the container in an aseptic condition once filled.

44. An aseptic container according to claim 43 wherein:

the sealing and retaining formation is adapted to seal and retain the plug within the flow passage in a second position which is different from the initial position of the first rupturable seal from which the plug is arranged to be withdrawn.

45. An aseptic container adapted to be filled with a flowable material from a filling and sterilization head of a filling apparatus, the aseptic container having a filling opening defining an exterior sterilizable surface for sterilization by the filling and sterilization head, the filling opening comprising:

a tubular body having a flow passage therethrough;

a plug for aseptically sealing the flow passage, an exterior portion of the plug being engagable by an engaging device of the filling head for removing and replacing the plug;

a first sealing and retaining arrangement adapted to retain the plug in the flow passage in an initial aseptically sealed position for maintaining the interior of the container in an aseptic condition prior to filling; and a second sealing and retaining arrangement adapted to retain the plug in the flow passage in a second aseptically sealed position after the container is filled.

46. An aseptic container as claimed in claim 45 wherein said first sealing and retaining arrangement includes a rupturable seal extending between the plug and the tubular body.

47. An aseptic container as claimed in claim 45 wherein said first sealing and retaining arrangement comprises a first rib and complementary recess formation.

48. An Aseptic container as claimed in claim 47 wherein said second sealing and retaining arrangement comprises a second rib and complementary recess formation.

49. An aseptic container as claimed in claim 48 wherein a rib or recess of the first rib and recess formation is subsequently used as a rib or recess that forms part of the second rib and recess formation.

50. An aseptic container as claimed in claim 47 wherein the complemental recess of at least one of the first or second sealing and retaining arrangements is at least partially filled with a sealing material.

51. An aseptic container as claimed in claim 45 wherein the second aseptically sealed position is deeper within the flow passage than the initial position.

* * * * *